US006332742B1

(12) United States Patent
Smith

(10) Patent No.: US 6,332,742 B1
(45) Date of Patent: Dec. 25, 2001

(54) WIRE BINDING MACHINE

(76) Inventor: Kevin Smith, 3 Prospect Street, Haworth, West Yorshire (GB), BD22 8PX ( * ) Notice: Subject to any disclaimer, the term of this patent is extended or adjusted under 35 U.S.C. 154(b) by 0 days.

(21) Appl. No.: 09/494,261

(22) Filed: Jan. 28, 2000

(30) Foreign Application Priority Data

Jan. 30, 1999 (GB) ..... 9901990

(51) Int. Cl.[7] ..... B42B 5/10
(52) U.S. Cl. ..... 412/38; 412/39
(58) Field of Search ..... 412/38, 39, 40, 412/42, 45, 33; 218/21.1

(56) References Cited

U.S. PATENT DOCUMENTS 5,059,078 10/1991 Schmid ..... 412/39
5,249,902 * 10/1993 Stankiewicz ..... 412/38
5,785,479 * 7/1998 Battisti et al. ..... 412/38 X
5,931,623 * 8/1999 Hastings et al. ..... 412/38 X

FOREIGN PATENT DOCUMENTS 2327204A 1/1999 (GB) .

* cited by examiner

*Primary Examiner*—Willmon Fridie, Jr.
(74) *Attorney, Agent, or Firm*—Oppenheimer Wolff & Donnelly LLP

(57) ABSTRACT

A binding machine for binding together punched sheets of paper includes means for temporarily retaining a wire binding element, to allow punched sheets to be hung thereon, and means for closing the retained wire binding element so that the closed points come into the vicinity of the open roots, in which the wire binding element retaining means includes a flap and finger plate having projections or fingers. The flap is mounted for pivoted movement such that the plate is pivoted away from an equilibrium position by insertion of the binding element but returns to the equilibrium position thereafter, thus retaining the wire binding element in a generally horizontal orientation between the flaps and the fingers.

14 Claims, 21 Drawing Sheets

WIRE BINDING MACHINE

FIELD OF THE INVENTION

The present invention relates to a machine for binding together a number of sheets of paper by means of wire binding elements.

BACKGROUND OF THE INVENTION

A wire binding element is manufactured from a length of deformable material such as wire bent into a series of hairpin shaped prongs on which punched sheets are hung, the machine then closing the generally C shaped binding element into a ring shape, thus bringing the closed ends or points of the prongs close to the open ends or roots. The sections of wire between the roots are referred to as blunts. This wire binding element will hereinafter be referred to as a wire binding element of the kind set forth.

There are several different machines of this type currently available, some of which also include means for punching holes in the sheets prior to binding. However, existing machine designs are generally difficult to operate and may require considerable manual dexterity, particularly in loading the binding element and in removing the bound document from the machine. Such existing machines also include manual means for closing the wire binding element as well as a manually operated adjustment mechanism to enable different sizes of binding element to be used, but such existing manual adjustment mechanisms are vague and time consuming to set up.

There is thus a need for a machine which is simpler to operate and provides a more definite adjustment mechanism allowing straightforward selection of the appropriate setting for the particular size of binding element being used.

It is therefore the aim of the present invention to provide an improved binding machine which overcomes these and other disadvantages of existing machine designs.

SUMMARY OF THE INVENTION

According to a first aspect of the present invention there is provided a binding machine for binding together a number of punched sheets of paper, the machine including:

means for temporarily retaining a wire binding element of the kind set forth so as to allow punched sheets to be hung thereon, means for closing the retained wire binding element so that the closed points come into the vicinity of the open roots, wherein the means for retaining the wire binding element includes a flap and finger plate comprising a number of projections or fingers, the flap being mounted for pivotal movement such that the plate is pivoted away from its equilibrium position by insertion of the binding element but returns to its equilibrium position thereafter, thus retaining the wire binding element in a generally horizontal orientation between the flap and the fingers.

The closing means may be powered by a drive mechanism, or alternatively it may be manual.

Preferably, the fingers are resiliently deformable. This assists in the release of the bound document as will be described hereinafter.

Preferably, the position of the flap is adjustable with respect to the closing means. This enables different sizes of wire binding elements to be utilised in the machine according to the number of pages to be bound.

Conveniently, the closing means comprises a base plate having an edge portion facing a closing surface, these two components being mounted for relative movement towards and away from each other whereby a wire binding element held therebetween is closed.

The closing surface preferably comprises a pivoting arm, movable between an inoperative up position and an operative down position. In the preferred embodiment the baseplate is arranged for to and fro movement relative to the pivoting arm.

The position of the flap relative to the base plate is preferably adjusted (for different wire sizes) by means of a cam and cam follower arrangement. Conveniently this is driven by a stepper motor.

The degree of to and fro movement of the base plate relative to the closing surface is conveniently adjusted simultaneously with the flap position adjustment, by means of a second cam the edge of which engages a limit switch at the end of the stroke, the length of the stroke thus being determined by the degree of rotation of the second cam.

According to a second aspect of the present invention there is provided a binding machine for binding together a number of punched sheets of paper, the machine including:

means for temporarily retaining a wire binding element of the kind set forth so as to allow punched sheets to be hung thereon, means for closing the retained wire binding element so that the closed points come into the vicinity of the open roots, wherein upon completion of closure of the wire binding element the bound document is automatically released from the machine.

Preferably, this is achieved by means of a pivoting flap co-operating with a finger plate comprising a number of resiliently deformable projections or fingers so as to temporarily retain the binding element therebetween. By manufacturing the flap from a resiliently deformable material, the retained wire itself can be pushed against the flap from the inside, thereby flexing the flap outwardly and releasing the closed binding element from the machine.

Preferably the pivot axis of the flap is positioned forwardly of the flap, whereby outward flexing of the flap will cause the flap lower edge to lift slightly, opening a gap between the fingers and the flap into which the closed binding element is released. Preferably, the pivot axis of the flap is on the flap centre line when releasing and in front when loading.

According to a third aspect of the present invention there is provided a binding machine for binding together a number of punched sheets of paper, the machine including:

means for temporarily retaining a wire binding element of the kind set forth so as to allow punched sheets to be hung thereon, means for closing the retained wire binding element so that the closed points come into the vicinity of the open roots, wherein the machine also includes means for punching holes in sheets of paper, said punching means and said means for closing the retained wire binding element both being activated by a single drive mechanism.

Preferably, said single drive mechanism comprises a drive cam and associated drive cam shaft, rotation of which drives the closing means and the punching means simultaneously and in opposite directions.

Conveniently, the punching means comprises a die with a row of holes therein and a co-operating row of headed punch pins, each adapted to be received within a corresponding hole in the die, the paper being inserted within the die.

Preferably, the punching means includes means for selectively disabling the punching of one or more holes, to accommodate different sizes of paper, eg A5 instead of the more usual A4. Conveniently, this is achieved by means of a solenoid operated pin disable mechanism.

Preferably, the machine includes a storage container, located underneath the die, into which the confetti generated by the punching operation falls.

Conventionally, such storage containers are in the form of a shallow tray which needs to be frequently emptied to avoid the confetti, which tends to build up in conical piles underneath each hole, from clogging the mechanism.

In the present invention the container is deeper and is generally A shaped, the top being truncated to form a relatively narrow opening which widens out towards the base, allowing for a much greater storage capacity and hence reducing the need for emptying.

According to a fourth aspect of the present invention there is provided a binding machine for binding together a number of punched sheets of paper, the machine including:

means for temporarily retaining a wire binding element of the kind set forth so as to allow punched sheets to be hung thereon, means for closing the retained wire binding element so that the closed points come into the vicinity of the open roots, wherein the machine includes an adjustment mechanism for adjusting the degree of closure to suit the size of binding element being employed, said adjustment mechanism comprising an adjustment cam.

Preferably, the adjustment cam is rotated by means of a stepper drive.

In the fifth aspect of the invention there is provided a machine incorporating all of above defined four aspects of the invention.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
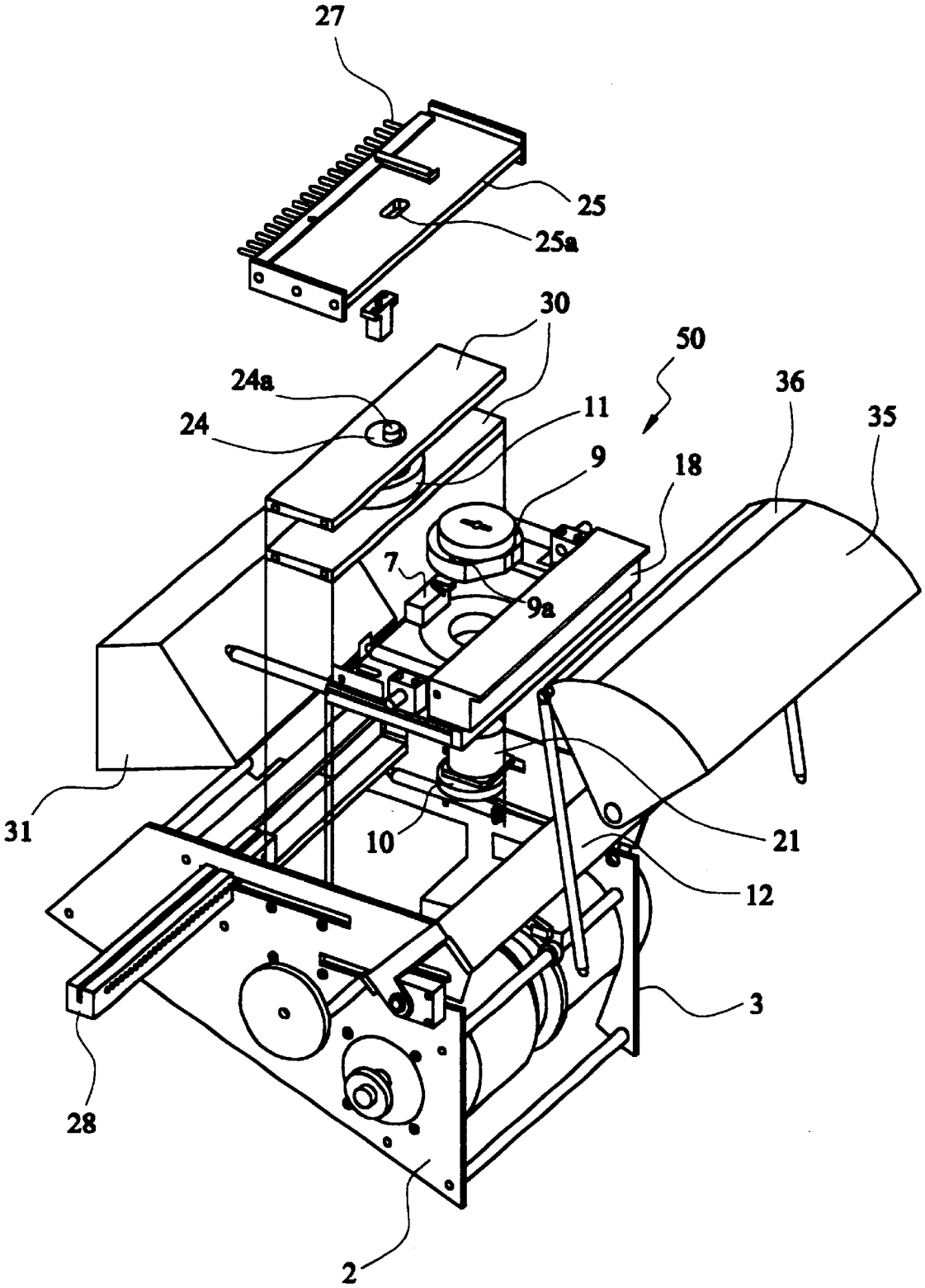
FIG. 1 is an exploded drawing of the binding machine in accordance with the present invention.

Referring to the drawings, a machine 50 according to the present invention comprises a binding element hanging and closure mechanism 18,12 at the front end and a punching mechanism 25,27,28 at the rear end, which are both powered from a central drive shaft 24 and associated cam 11 with eccentric end 24*a,* mounted intermediate the two mechanisms.

Figure 12:
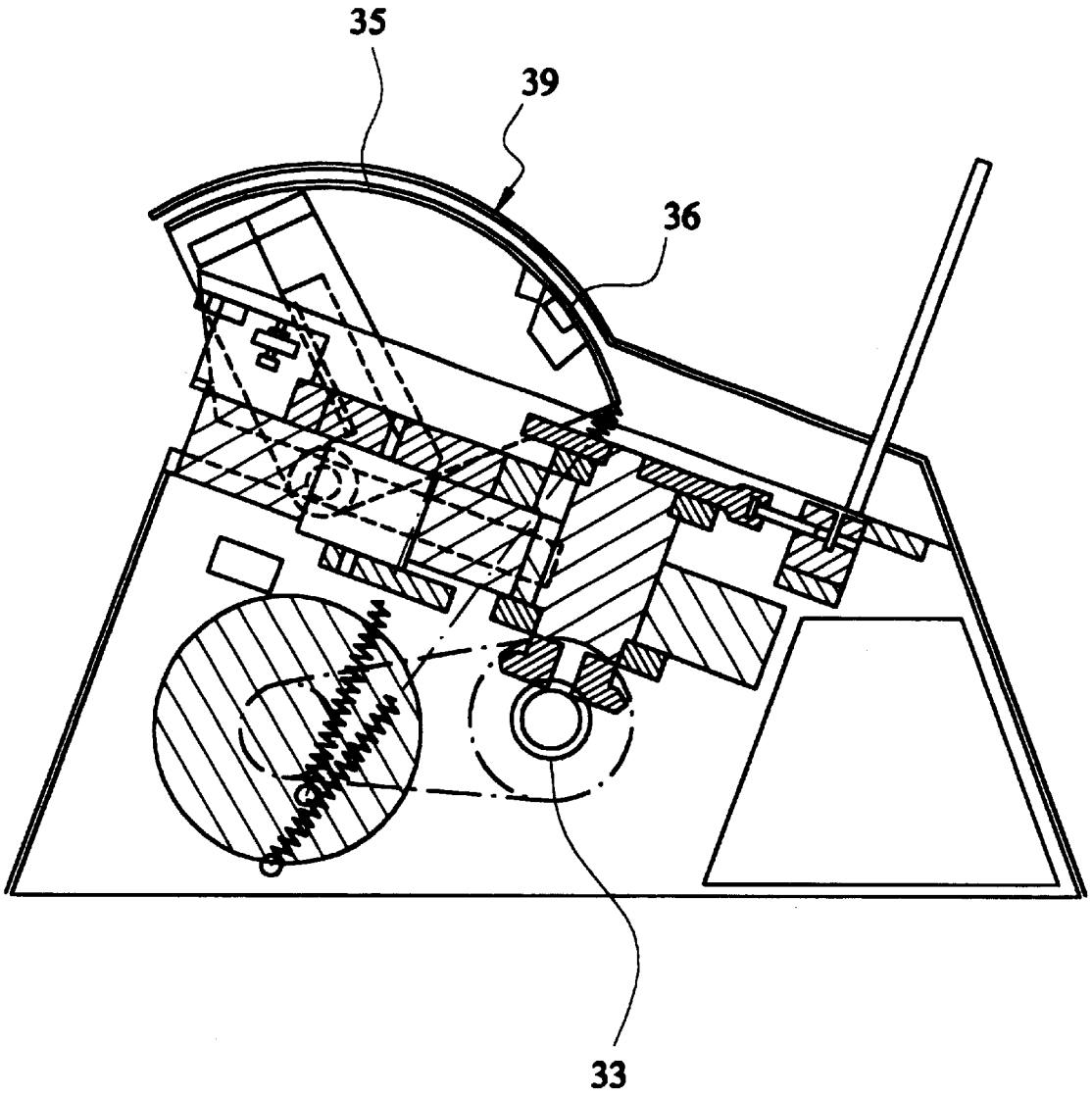
FIG. 12 illustrates the guard in the up position.

A guard 35 acts as both safety shield and machine enables, revealing control console 36 when pivoted downwards. As shown in FIG. 12, the guard 35 is in the up position, in which power is isolated from the drive assembly and the control console 36 is shielded under the main cover 39, thus inhibiting operation of the machine.

Figure 13:
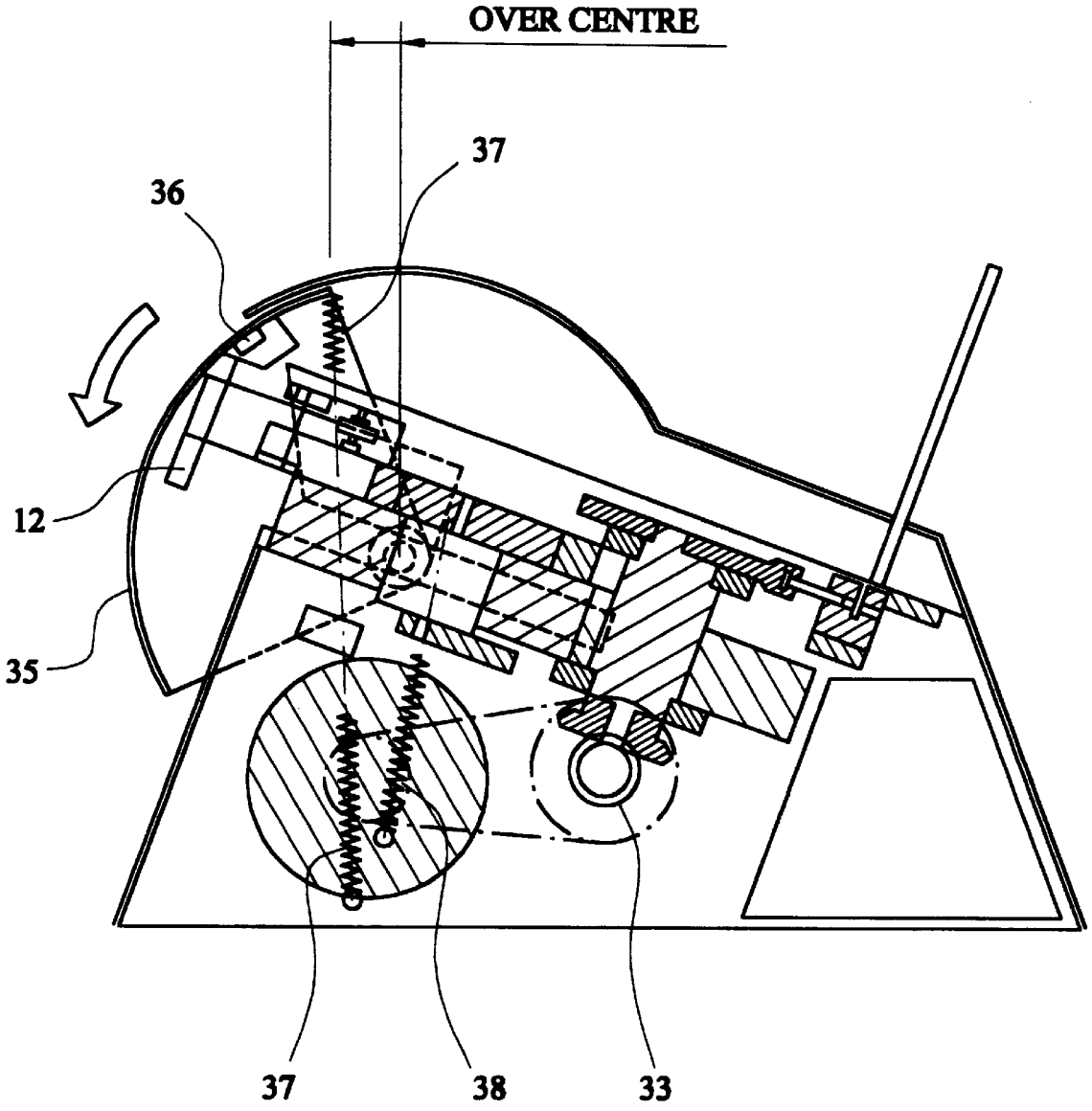
FIG. 13 illustrates movement of the guard into the down position.

As shown in FIG. 13, the guard 35 is moved manually into the down position, which movement in turn moves the closer arm 12 into the down position—the over centre action of the guard spring 37 and the weight of the guard 35 together act to hold the closer arm 12 in position when the operator releases the guard 35.

A deep, A-shaped open-topped confetti storage container 31 is located towards the rear of the machine, underneath the punching mechanism.

The main binding operation and the machine components associated therewith will now be described in detail.

Figure 22:
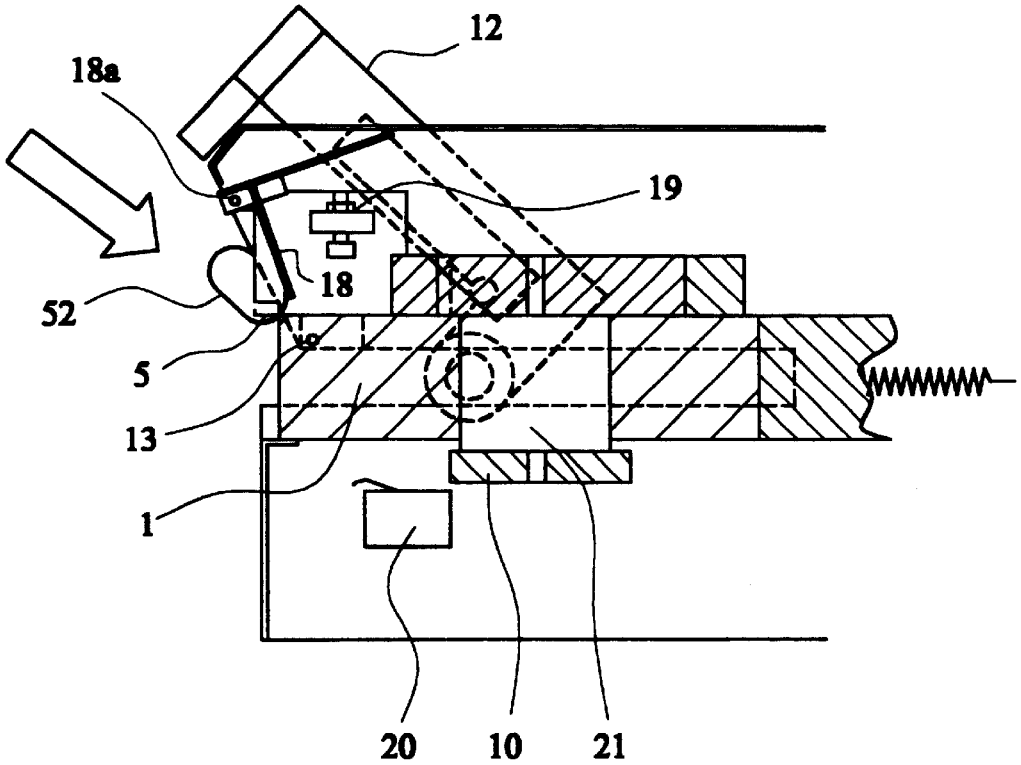
FIG. 22 illustrates the wire loading mechanism.
Figure 23:
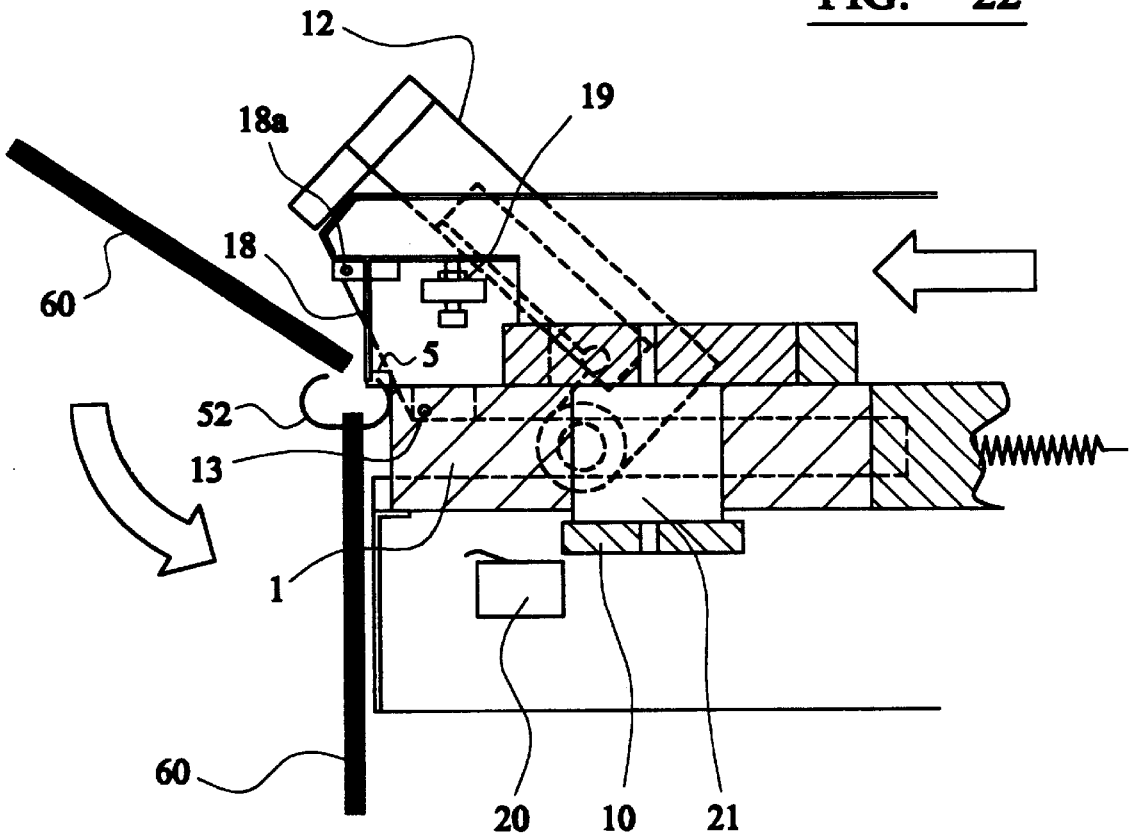
FIG. 23 illustrates paper loading.

The main parts of the hanging/closure mechanism comprise a pivoting flap 18 mounted for pivotal movement about pivot axis 18*a* (see FIG. 22). As a wire binding element 52 of the kind set forth is offered up to the machine and pushed by the operator against the flap 18, the latter pivots inwardly, and since the pivot axis 18*a* is a short distance in front of the flap 18, the lower edge of the flap is lifted up. The wire element 52 is then slid down the front face of the flap 18 until the individual fingers in the finger plate 5 engage with the blunts in the binding element 52, the blunts resting on the fingers such that contact between the binding element and the pivoting flap is broken, allowing the flap to pivot under gravity back to its original, equilibrium position. Thus, when the operator releases the binding element it is retained between finger plate 5 and pivoting flap 18. This is shown in FIG. 23, in which position pre-punched paper sheets 60 are hung on the binding element 52.

Figure 24:
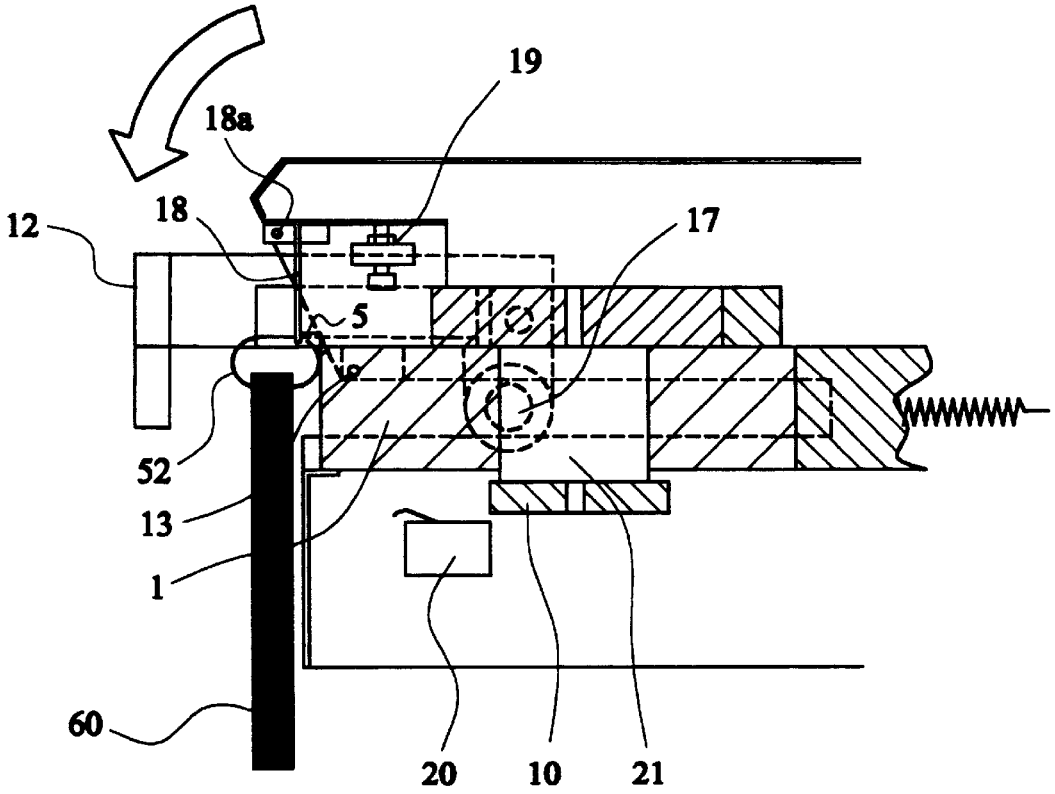
FIGS. 24 and 25 illustrate commencement of the closing operation.
Figure 25:
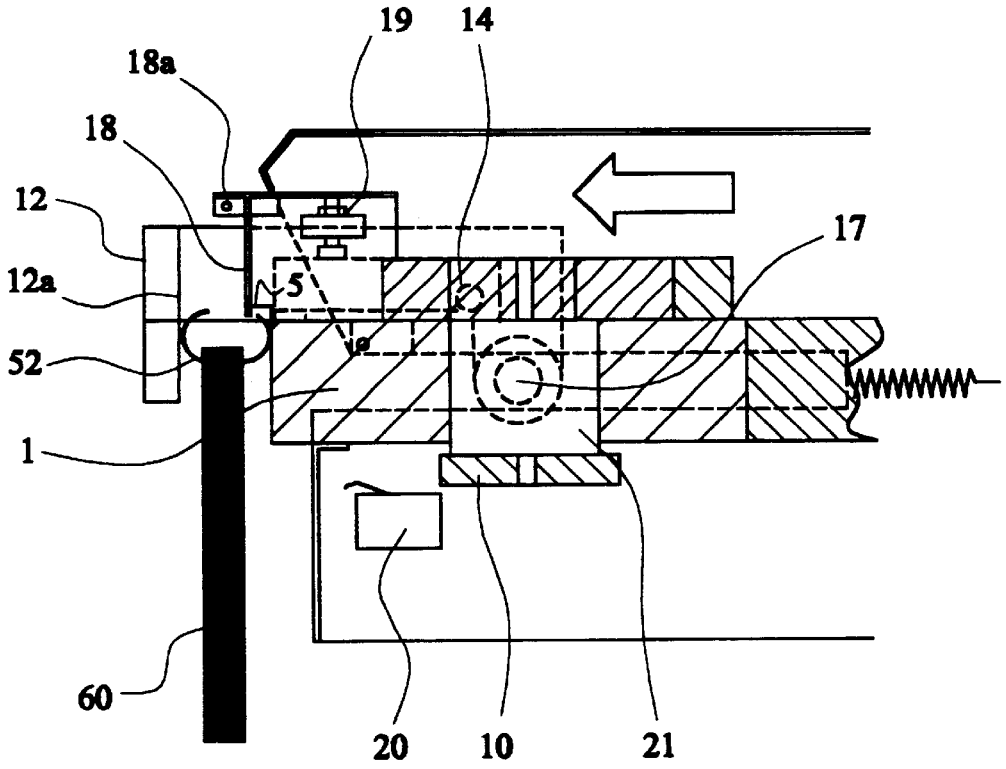

As shown in FIG. 24, with the paper hung on the binding element 52 which is itself held between flap 18 and finger plate 5, the closer arm 12 is pivoted downwardly, by moving the guard 35 manually downwards and towards the operator (thus revealing control console 36 and allowing power-up of the machine) until the inner angle of the closer arm engages with the stop 13. Then, as shown in FIG. 25, the base plate 1 along with all its attachments is pushed, in the direction shown by the large arrow, by activation of the main closing cam 11 , towards the inner face 12*a* of the closer arm 12. In this position the closer arm locking pin 14 is above the angle on the closer arm 12, thus restricting any angular movement and effectively locking the closer arm in the down position.

Figure 26:
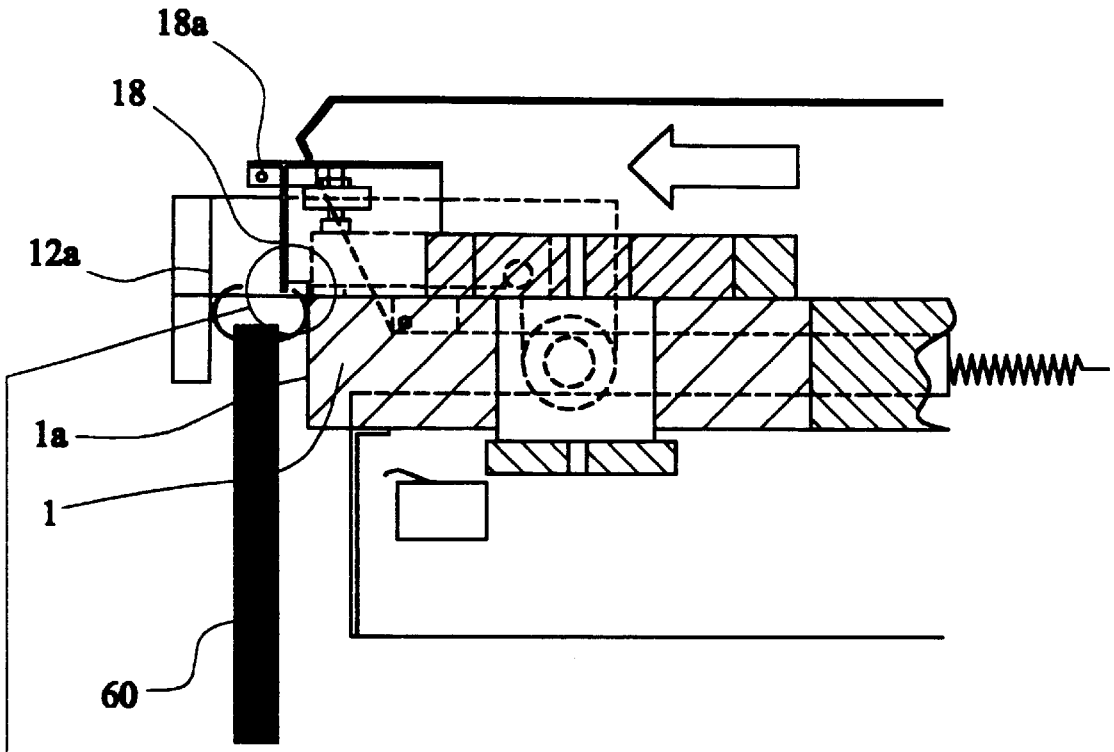
FIGS. 26 and 27 illustrate release of the bound document.
Figure 26A:
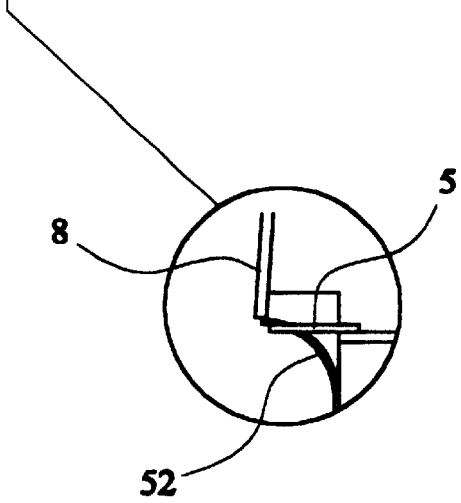
Figure 26B:
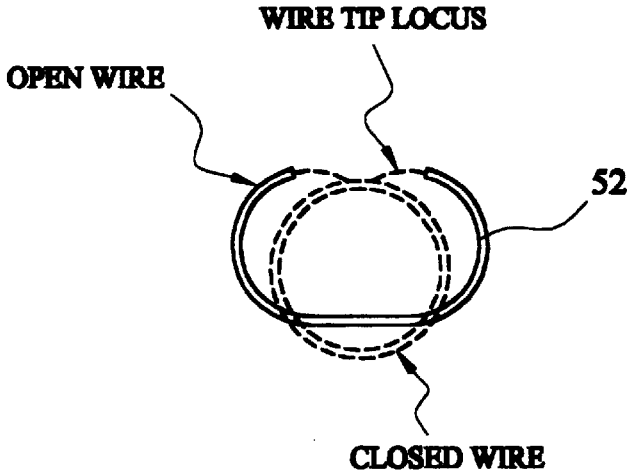

The actual closing of wire binding element 52 is illustrated in FIG. 26. The opposed faces 12*a* of closer arm 12 and 1*a* of base plate 1, having been roughened by sand blasting or similar procedure, such that the element 52 is gripped between the two faces. As base plate 1 continues to be driven towards closer arm face 12*a,* the element 52 is closed, the wire tips tracing the loci shown in FIG. 26*b.* During this closing movement, the wire tips retained between the flap 18 and finger plate 5 move forward and engage the inner surface of flap 18, pushing the edge of flap 18 outwardly as shown in FIG. 26*a.* As the flap 18 is now flexing about a pivot axis on its centre line, rather than pivoting about pivot axis 18*a* located forwardly of its centre, as occurred during wire loading, the lower edge of the flap 18 rises relative to the wire until the wire is released. This automatic releasing of the binding element 52 is assisted by the deflection of the resiliently deformable fingers of finger plate 5.

Figure 27:
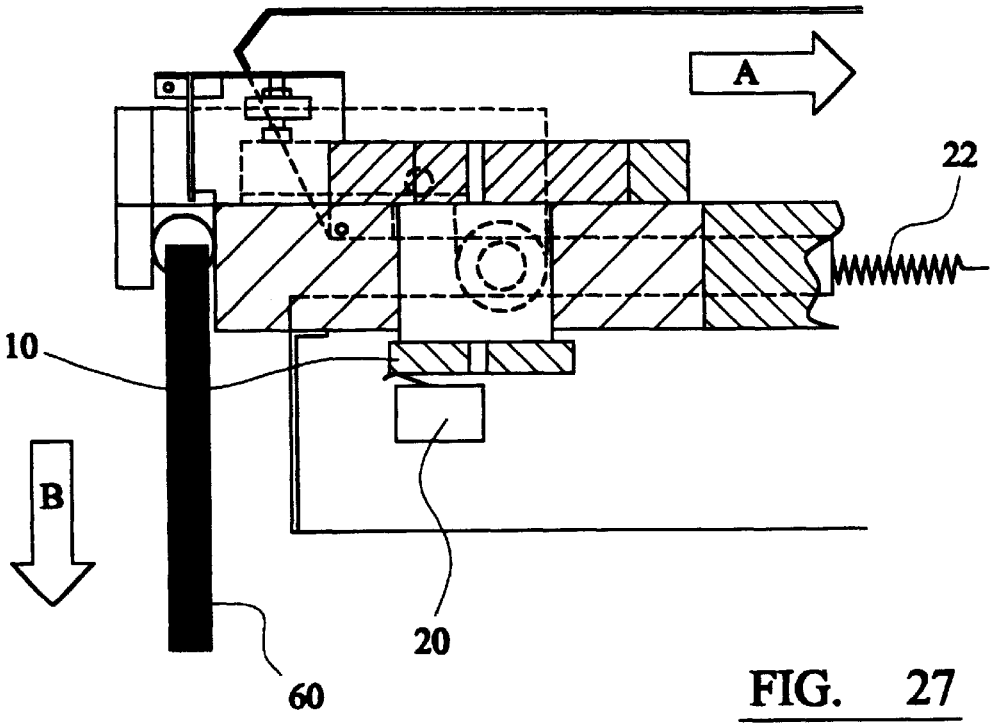

Completion of the closing stroke occurs when cam 10 hits limit switch 20, whereupon the drive to the drive cam 11 is reversed, allowing the base plate to return to its original position in the direction shown by arrow A in FIG. 27, by means of base plate return springs 22. Pages 60 bound by closed element 52 are thereby automatically released from the machine, in the direction of arrow B.

Figure 28:
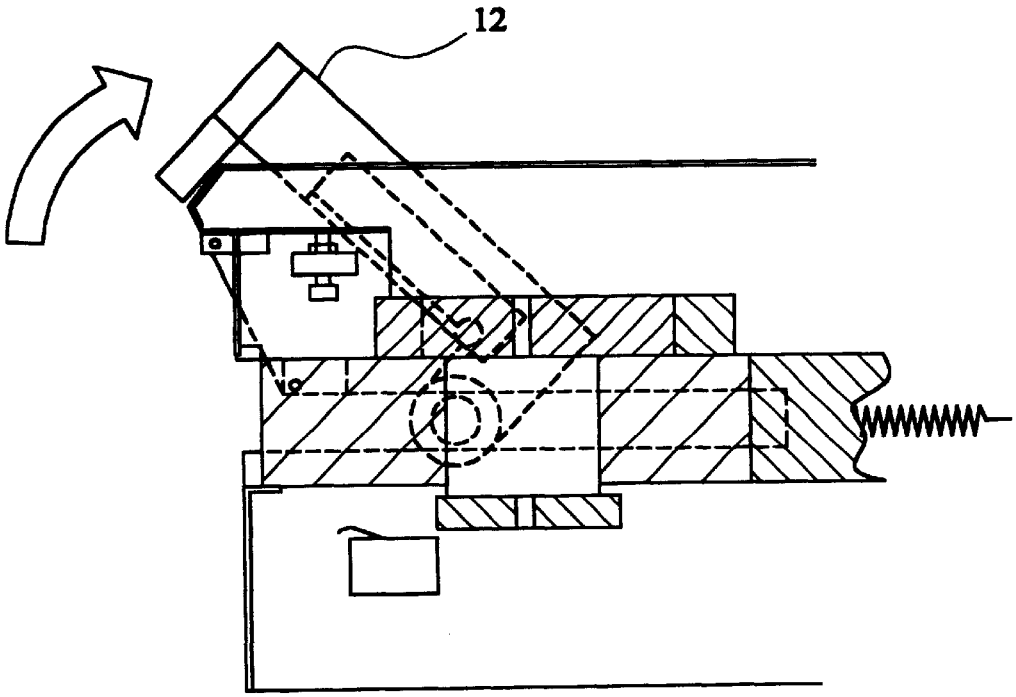
FIG. 28 illustrates the return of the closer to its original position, ready for re-loading.

The closer arm 12 is then allowed to return to the up position as shown in FIG. 28, under the action of springs 38, ready for the next binding operation.

The operation of the punching mechanism, located at the other end of the machine (i.e the end furthest away from the operator) will now be described in detail, with reference in particular to FIGS. 12 to 15.

In this position, the control console 36 is exposed and power is connected to the main drive assembly, as has been previously described. After selecting the appropriate wire/bind setting from console 36 (the adjustment mechanism is described in detail hereinafter), paper is dropped into the punch die 28, using the paper support 40 (see FIG. 14). Once the paper is in position in the die 28, two button type switches located at each end of the console 36 are pressed simultaneously (necessitating two handed operation to avoid possibility of inserting fingers into machine during punching), thereby activating the main drive which in turn rotates cam shaft 24. During such rotation, the eccentric end 24*a* of cam shaft 24 locates within a slot 25*a* in the punch drive plate 25, such that when the cam shaft rotates the plate 25 moves in a linear motion which pushes the punch pins 27 through the die 28 and the paper 62 therein (see FIG. 15). When the cam 10 hits the limit switch 20 the drive is reversed until the plates 1 and 25 resume their original position.

For normal A4 punching all the pins 27 will be utilised, but for A5 punching it is necessary to inhibit the operation of one of the pins (to avoid a partial hole being punched right at the edge of the paper). For this purpose an A5 punch pin disengagement mechanism is provided, the structure and operation of which is illustrated in FIGS. 3 through 8.

Figure 3:
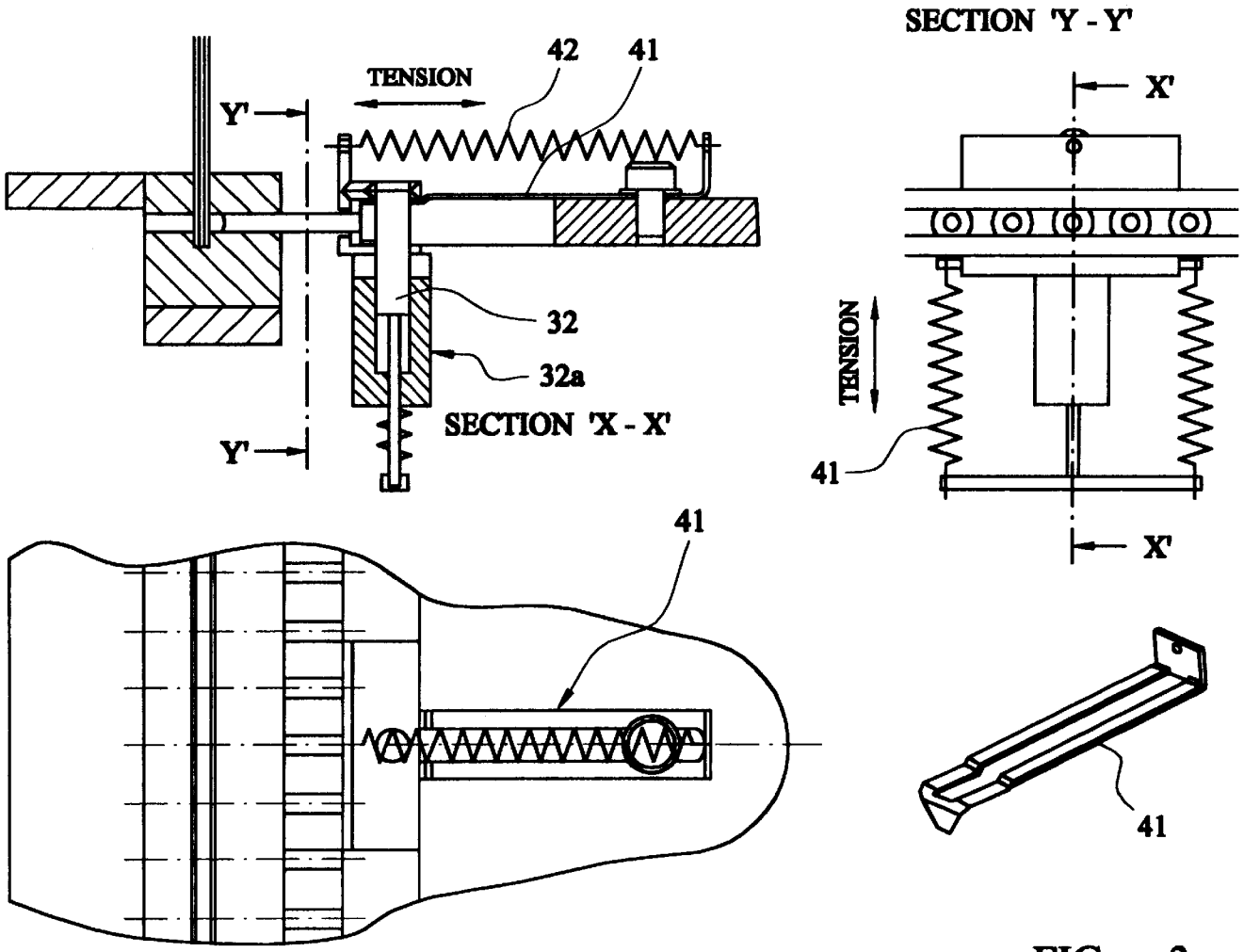
FIG. 3 illustrates the A5 punch pin sub-assembly.
Figure 4:
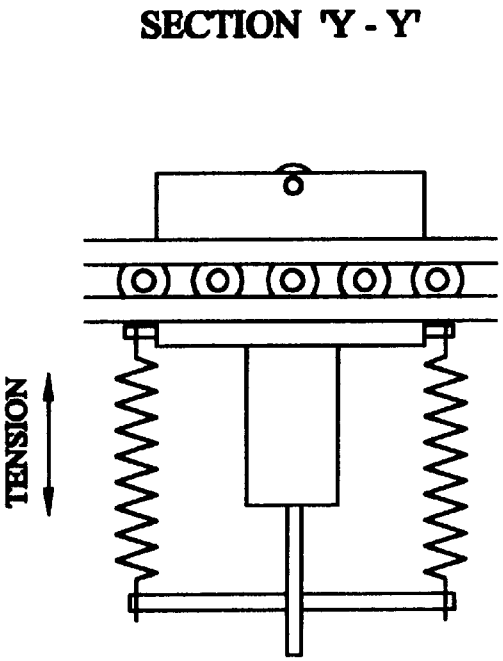
FIGS. 4 and 5 illustrate the position of the A5 sub-assembly during punching operation for A4 paper.
Figure 4:
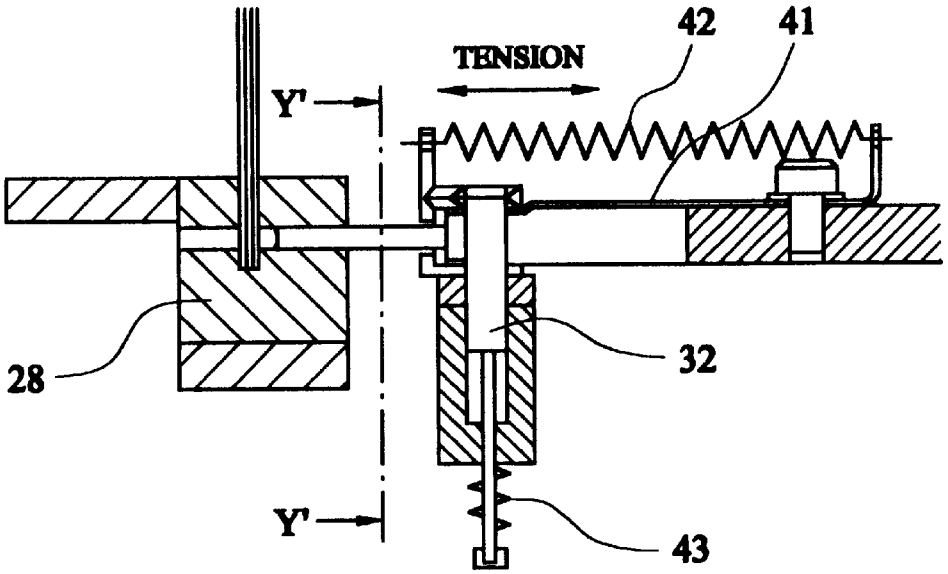

At least one of the pins 27 is provided with a recess into which the pin is pushed by contact with the paper, but the pin is normally prevented (during A4 operation) from entering this recess by means of solenoid plunger 32. As shown in FIG. 3, the punch pin return finger spring 42 is in tension, pulling the punch pin return finger 41 to a position which allows the solenoid plunger 32 to pass through a slot running along its length. The solenoid is de-energised and the solenoid return spring assembly 43 in tension, thereby pulling the solenoid plunger 32 through the punch pin return finger 41 into the opposing hole, making a rigid face behind the pin 27. In this position, when the punch drive plate 25 is activated the assembly pushes the punch pin 27 through the paper, as shown in FIG. 4.

Figure 6:
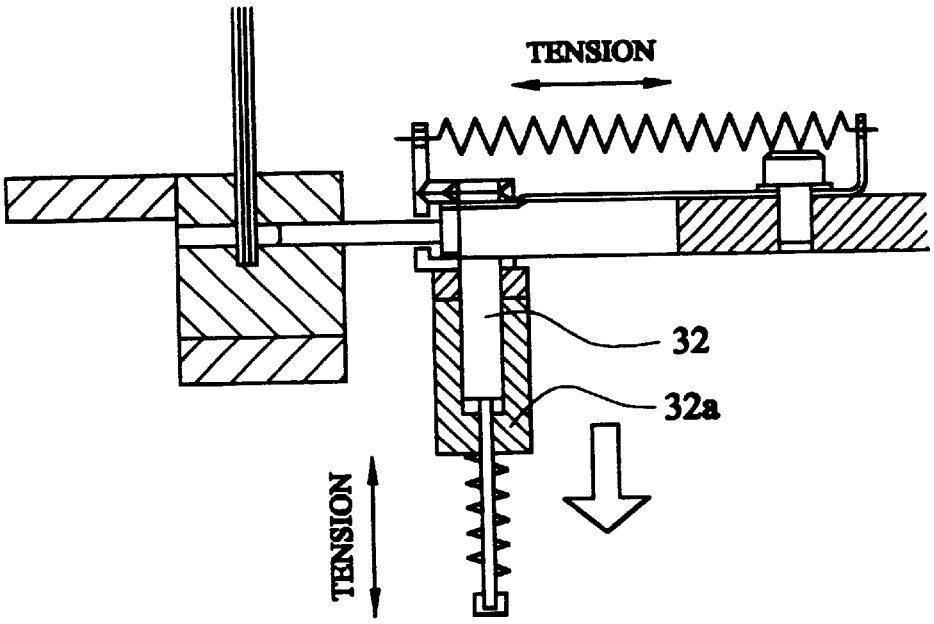
FIGS. 6, 7 and 8 illustrate the disengagement of the A5 punch pin for A5 punching.

However, when the A5 disable solenoid is energised, the plunger 32 is retracted into its housing 32*a,* thus removing the main support from behind the punch pin (see FIG. 6). In this position, activation of the punch drive plate 25 pushes the pin 27 towards the paper, and when contact is made the paper resistance pushes the punch pin return finger 41 back into its slot, against the action of the punch pin return finger spring 42 which stops the hole from being punched (see FIG. 7). As the punch drive plate 25 retracts, the punch pin return finger 41 pushes against the head of punch pin 27, pushing it back into the die 28. Upon completion of the stroke, the punch pin return finger is back in its original position in which it can accept the A5 disable solenoid plunger 32.

Next, the adjustment mechanism will be described in detail, with reference to FIGS. 16 through 21. The machine is adapted to accept all binding element sizes from small ones used to bind calendars and the like, to large ones suitable for binding documents over 25 mm thick. It is important to adjust the machine to the correct wire setting in order to allow the binding element 52 to sit horizontally when loaded in the machine, and this is achieved by positioning the retaining flap 18 with respect to the base plate 1. The retaining flap pivot 18*a* is attached to upper plate 4 and this upper plate 4 is moved relative to base plate 1 to effect the flap position adjustment. Rotation of the wire size adjustment cam 9 puts a force on the upper plate adjustment stop block 7. Stop block 7 is attached to upper plate 4 and so rotation of cam 9 is translated into movement of upper plate 4 (and hence pivot axis 18*a*) relative to base plate 1.

Figure 2:
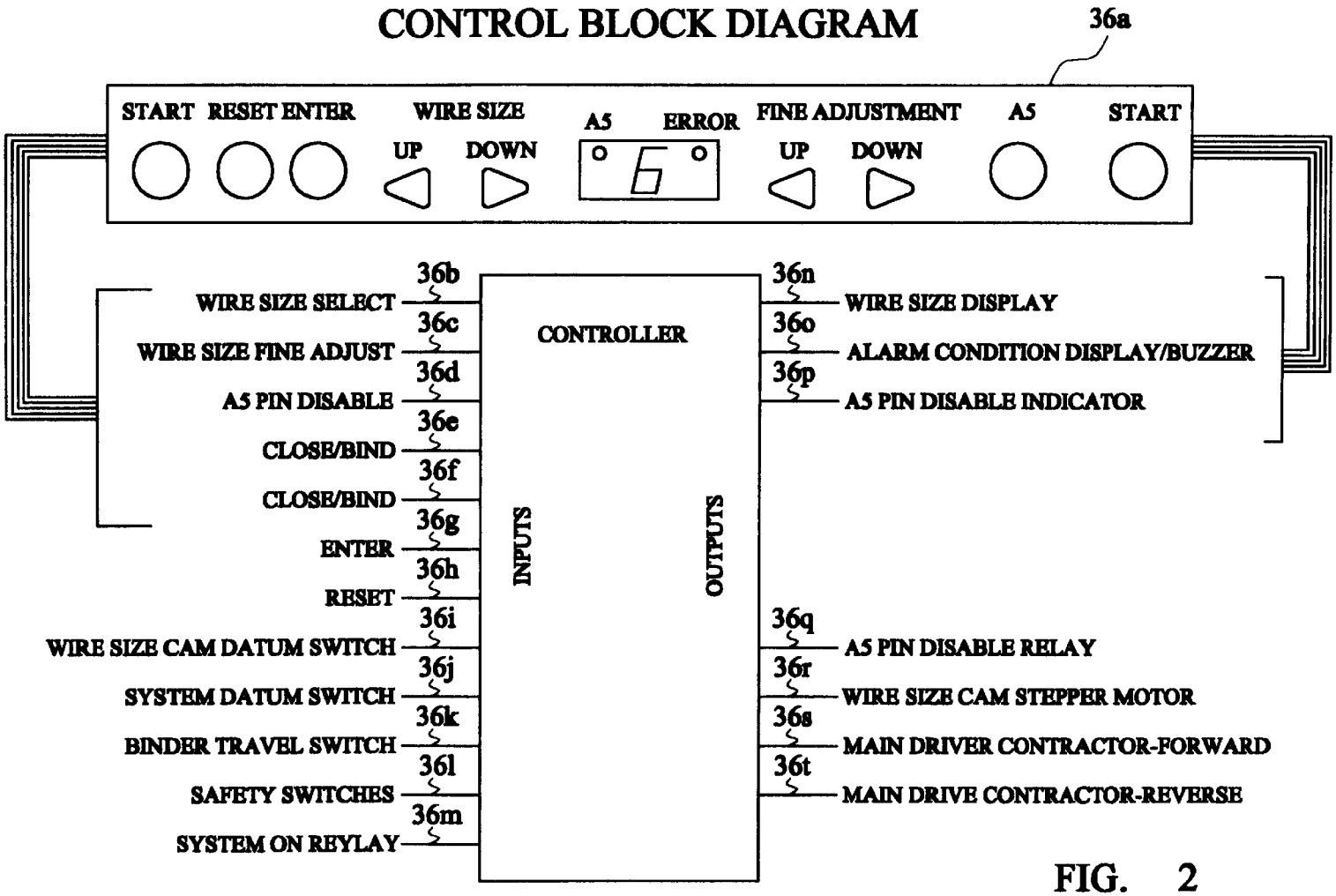
FIG. 2 is a drawing of the control system.

The cam 9 is rotated by use of a stepper motor 21 located in the base plate 1, the stepper motor being activated from the main unit controller. This is shown schematically in FIG. 2, comprising keypad 36*a* and controller with inputs 36*b* through 36*m* and outputs 36*n* through 36*t* as follows:

Inputs

- 36*b*—Wire size select
- 36*c*—wire size fine adjust
- 36*d*—A5 pin disable
- 36*e*—Close/bind
- 36*f*—Close/bind
- 36*g*—Enter
- 36*h*—Reset
- 36*i*—Wire size cam datum switch
- 36*j*—System datum switch
- 36*k*—Binder travel switch
- 36*l*—Safety switches
- 36*m*—system on relay Outputs

- 36*n*—wire size display
- 36*o*—alarm condition display/buzzer
- 36*p*—A5 pin disable indicator
- 36*q*—A5 pin disable relay
- 36*r*—wire size cam stepper motor
- 36*s*—main drive contactor (forward)
- 36*t*—main drive contactor (reverse)

The operator enters the wire size on a keypad on console 36, this in turn rotates the cam 9 via the stepper motor 21 until cam 9 is in the correct position for the selected wire size setting (as measured from cam datum pin 9*a*)—the smaller the wire size the larger the closing stroke as measured by the distance travelled by base plate 1 towards closer arm surface 12*a*.

Figure 18:
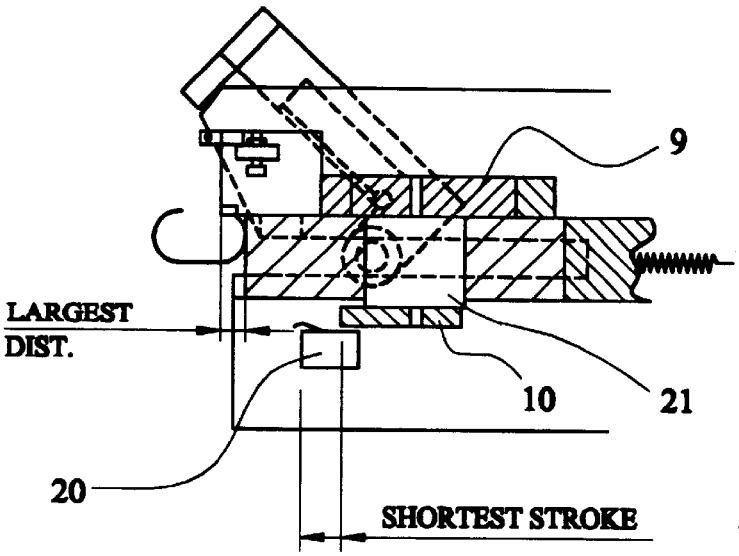
Figure 19:
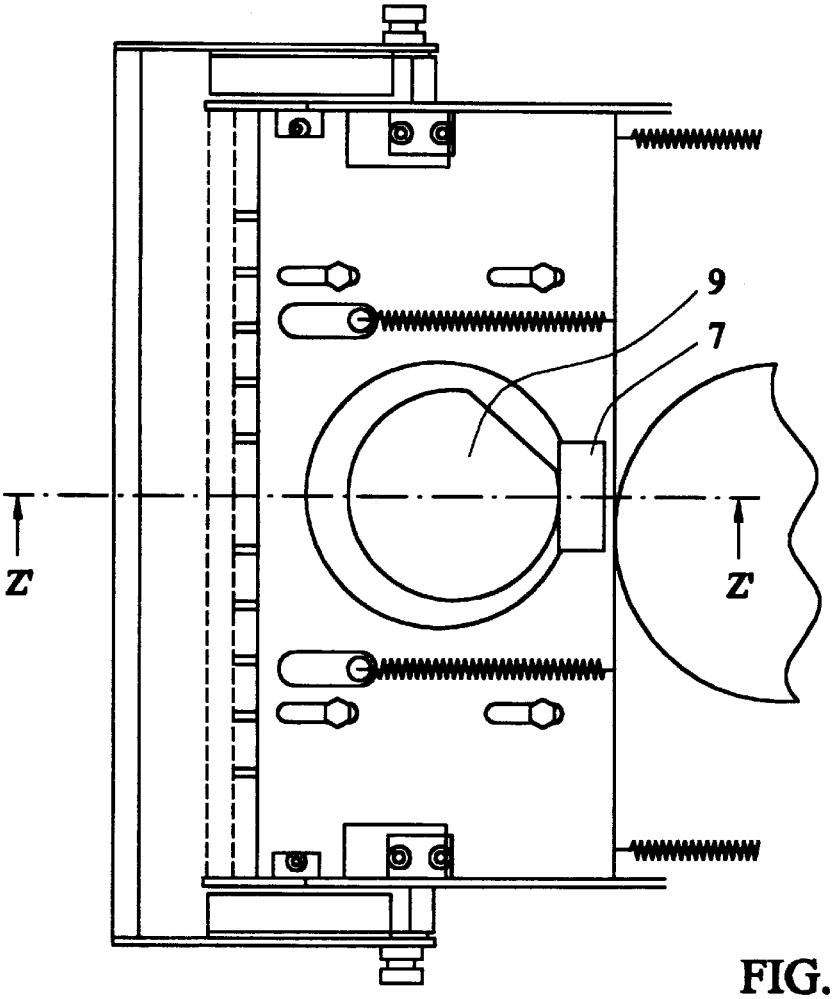
Figure 20:
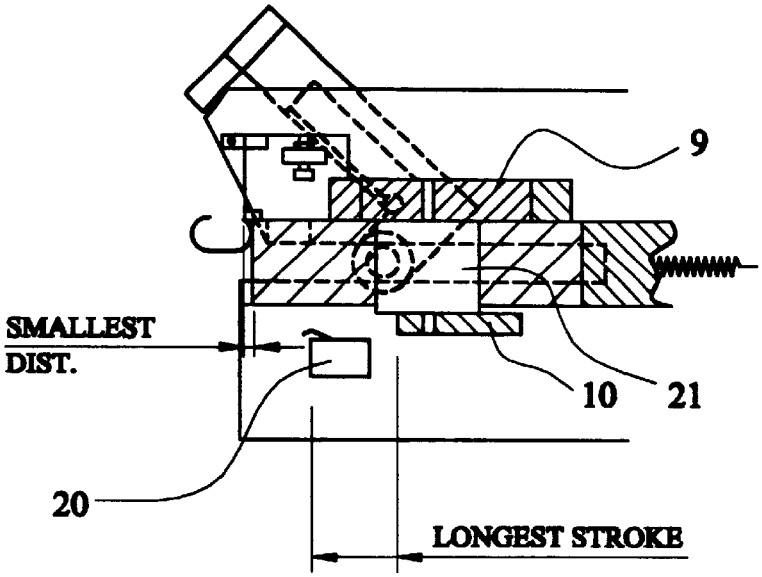
Figure 21:
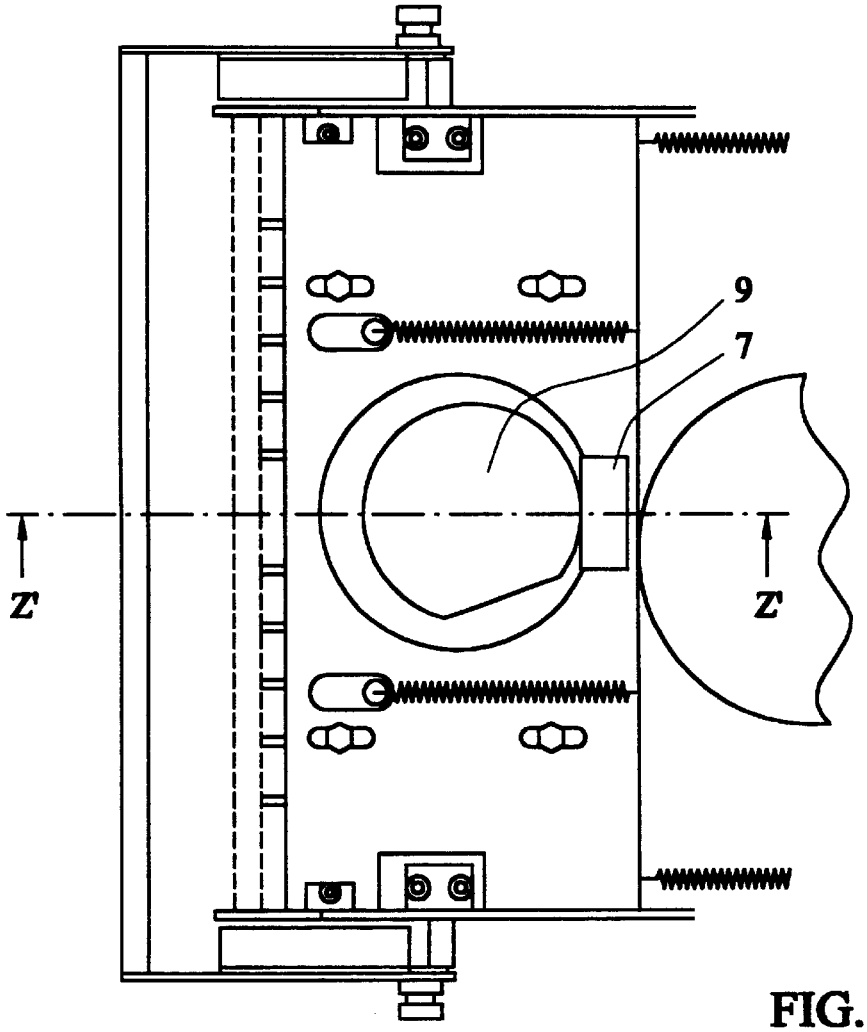

The shaft of the stepper motor 21 extends downwardly from the bottom of the motor, where closing travel adjustment cam 10 is mounted for rotation with the motor shaft, thereby giving the required setting. Whatever the setting, the drive is reversed when cam 10 hits limit switch 20, automatically releasing the bound document and returning the base plate 1 and all its attachments to the original position, as described above. FIGS. 18 and 19 illustrate the positions of cams 9 and 10 when set for the largest wire size (i.e shortest stroke), and FIGS. 20 and 21 show the positions of these items when set for the smallest wire size (longest stroke).

Whilst it is anticipated that the machine according to the present invention will mainly be used for punching and binding in two, separate operations the unique arrangement of the punching and binding mechanisms whereby both are activated simultaneously with a single drive mechanism means that for small wire sizes at least, simultaneous punching and binding is possible. It is believed that this capability for simultaneous punching and binding is both novel and inventive, as it allows for much faster operation in a mass production situation—the operator can thus bind the previously punched document at the same time as punching the next set of pages to be bound, speeding up the process considerably.

Text Associated with the Figures

FIG. 3—A5 punch pin sub assembly

FIG. 4—A4 punch pin engaged; stage no. 1

1. The punch pin return finger spring (42) is in tension and pulls the punch pin return finger (41) to a position that allows the plunger in item No. 32 to pass through the slot that runs along its length.
2. The A5 disenable solenoid (32) is de-energised and the A5 disenable solenoid return spring assy (43) is in tension therefore pulling the plunger through the punch pin return finger into the opposing hole thus making a rigid face behind the A5 pin.

Figure 5:
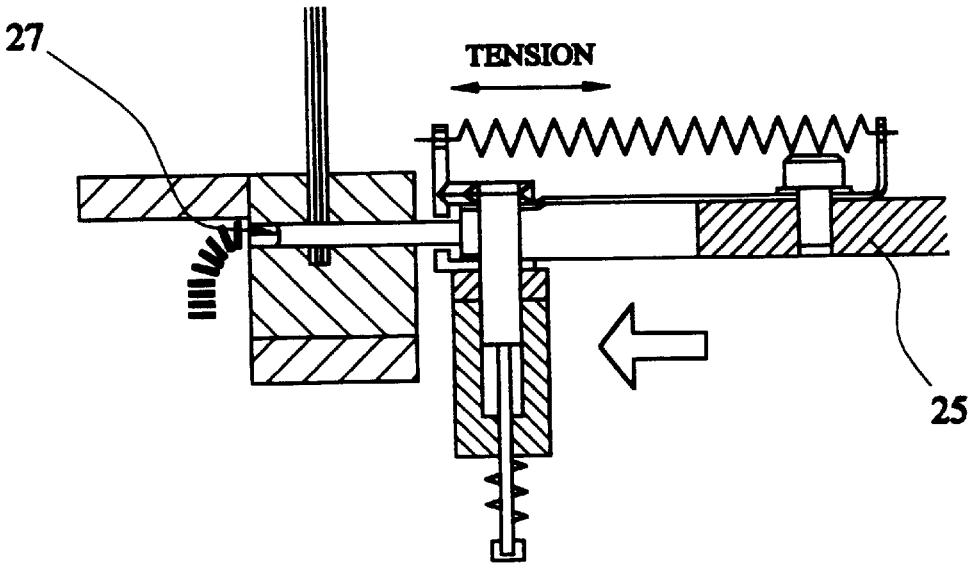

FIG. 5—A4 punch pin engaged; stage no. 2

1. When the punch drive plate (25) is activated the assembly pushes the punch pin (27) through the paper.

FIG. 6—A5 punch pin disengaged; stage no. 1

1. The A5 disenable solenoid (32) is energised and the plunger is retracted into its housing thus removing the main support from behind the punch pin.

Figure 7:
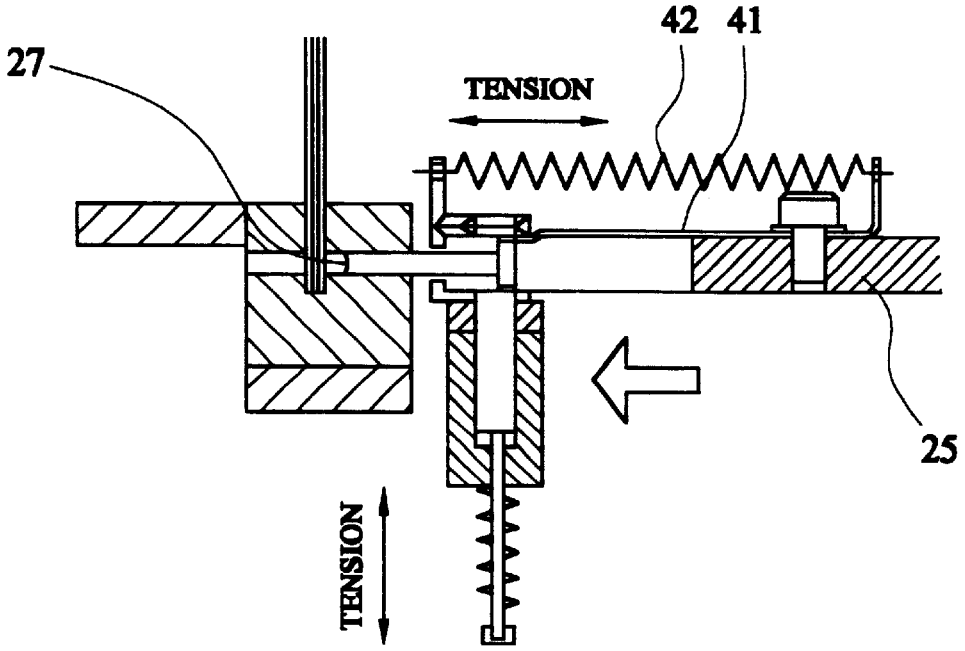

FIG. 7—A5 punch pin disengaged; stage no. 2

1. When the punch plate (25) is activated the punch pin (27) is pushed towards the paper, when contact is made the paper resistance pushes the punch pin return finger (41) back into its slot against the pressure of the punch pin return finger spring (42) thus stopping the A5 hole being punched.

Figure 8:
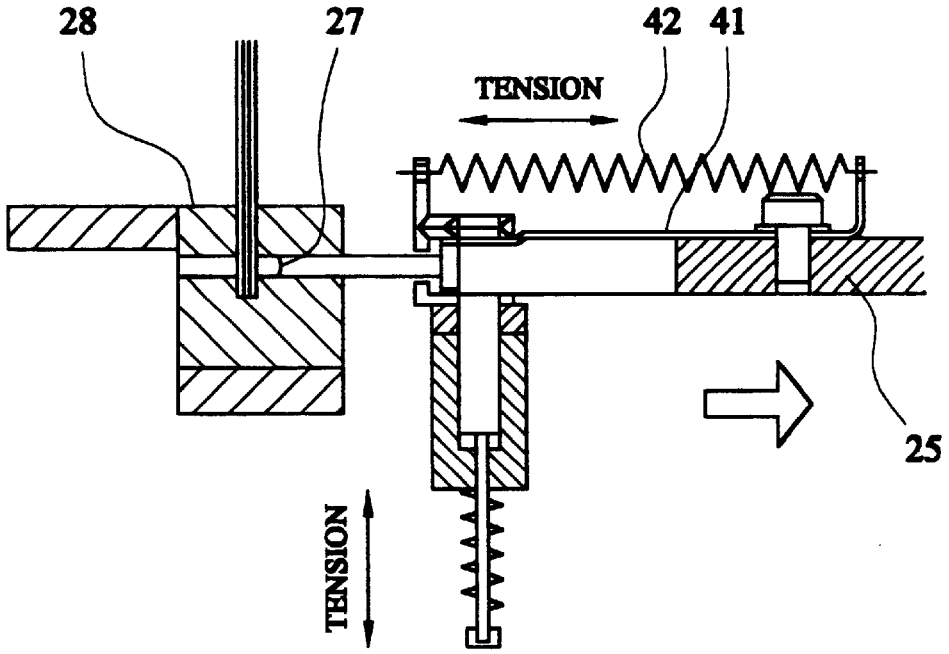
Figure 8A:
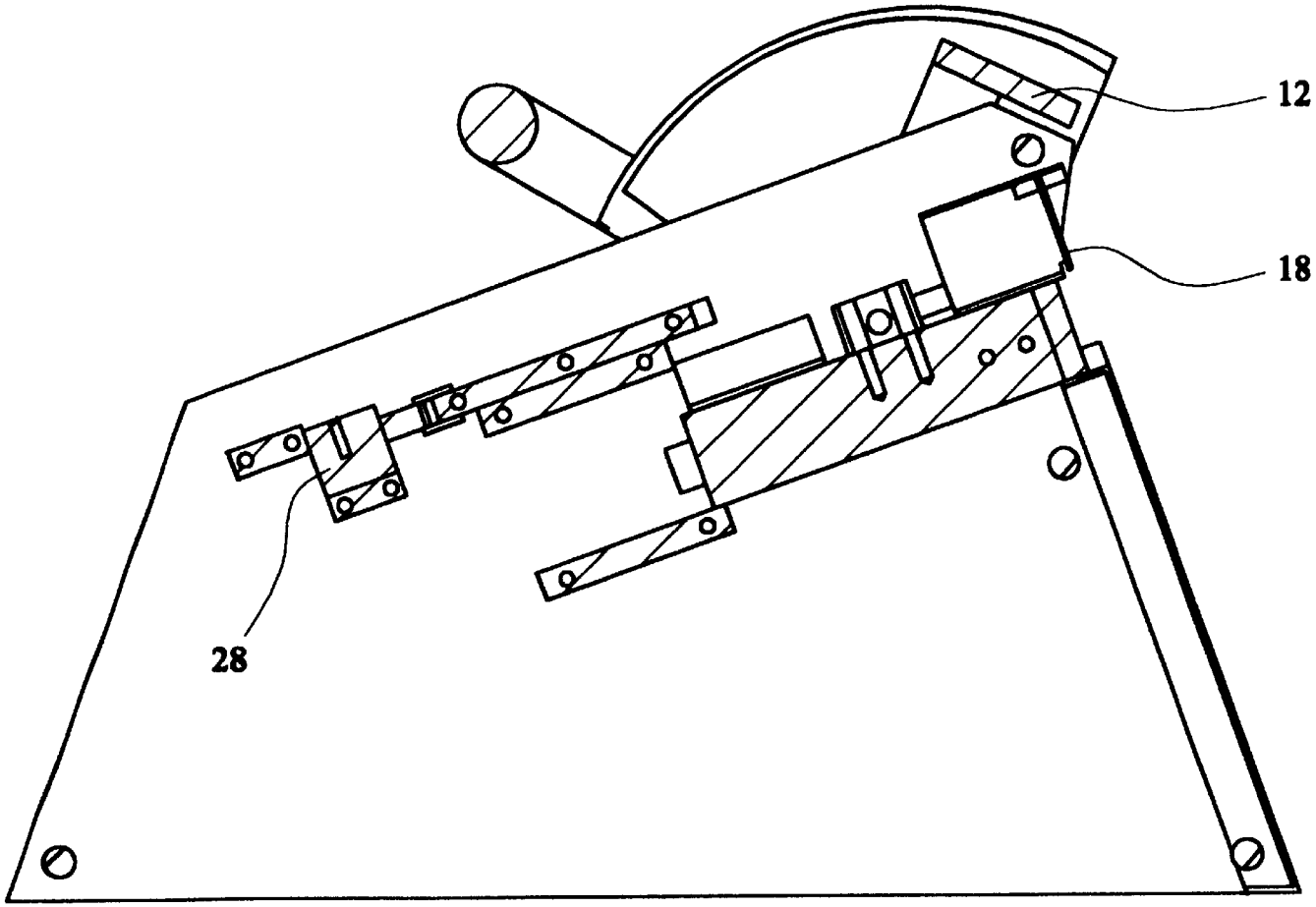
FIGS. 8A and 9 are both vertical section through the machine.
Figure 9:
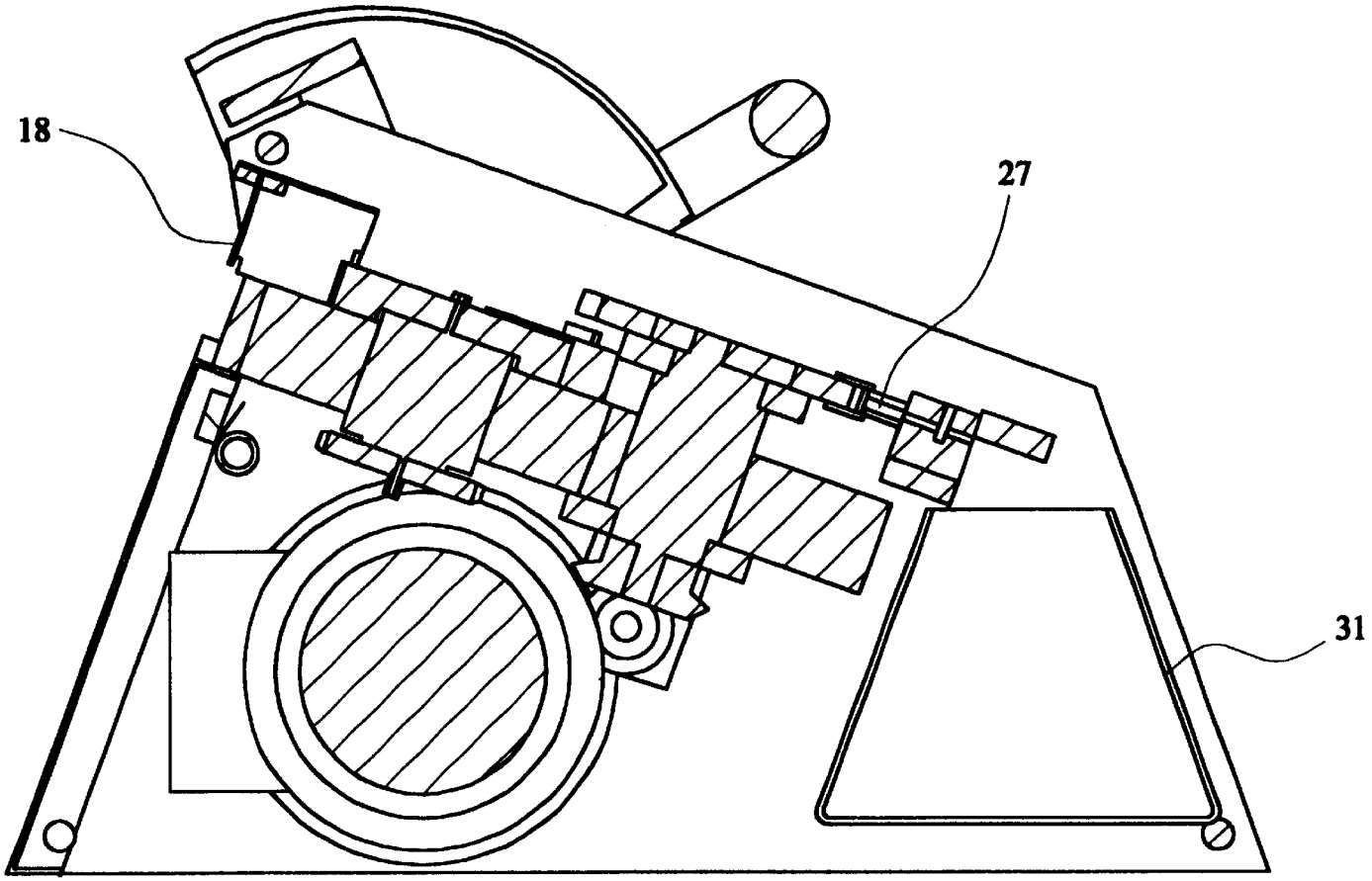
Figure 10:
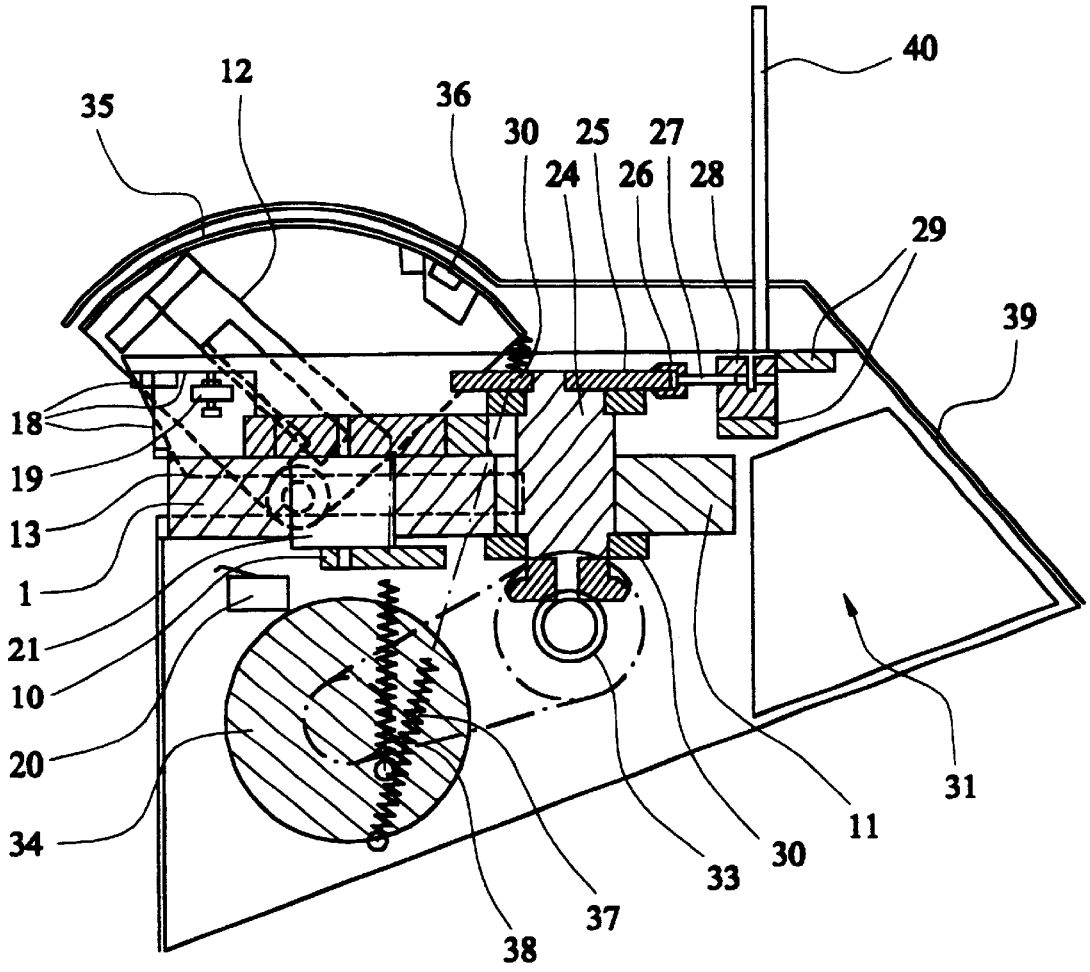
FIGS. 10 and 11 illustrate the general arrangement of the machine.
Figure 11:
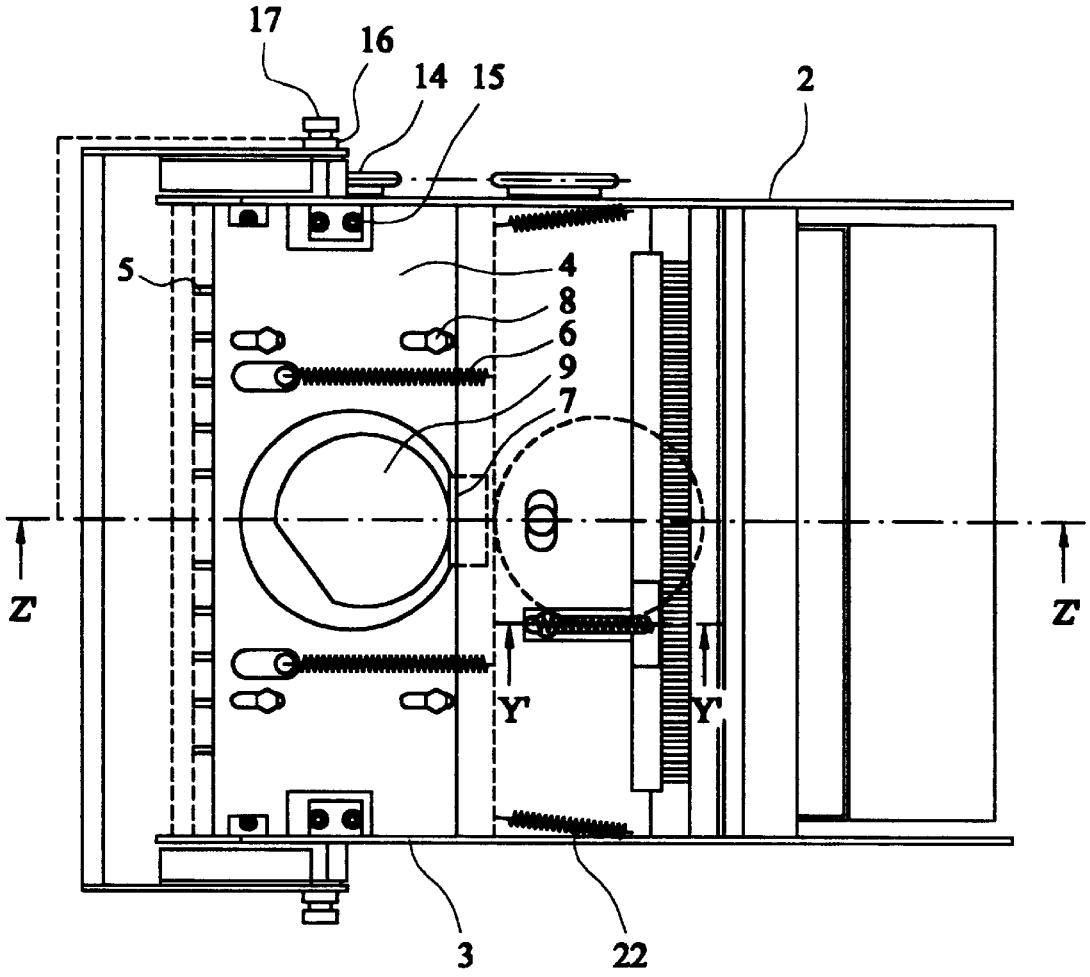
Figure 11A:
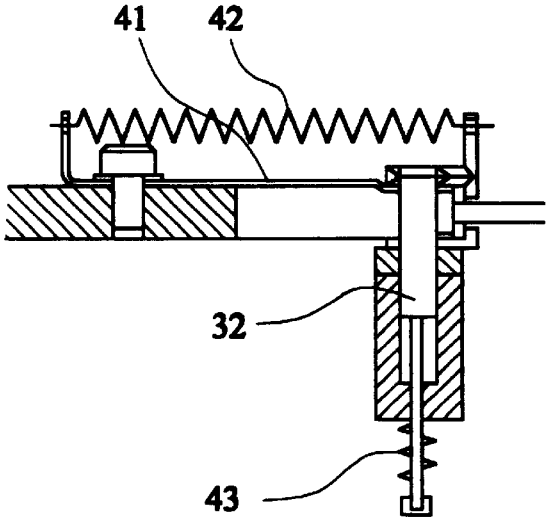
FIG. 11A illustrates the A5 punch pin disengagement mechanism.

FIG. 8—A5 punch pin disengaged; stage no. 3

1. As the punch drive plate (25) retracts the punch pin finger (41) pushes against the head of the punch pin (27) pushing it back into the die (28).
2. When the stroke is complete the punch pin return finger is back in its original position that can accept the A5 disenable solenoid plunger.

FIG. 12—M/C off; stage no. 1

1. The guard is in the upper position which isolates power from the drive and shields the control console (36) under the main cover (39) inhibiting any machine operation.

FIG. 13—Guard placement; stage no. 2

1. The guard (35) is manually moved into its closed position, this in turn moves the closer bracket (12) into position.
2. The over centre action of the guard spring (37) and the guard weight hold the closer bracket in position when the guard is released.
3. The control console (36) is now visible and power is made available to the main drive.
4. The "smallest wire/bind" setting is selected from the control console.

Figure 14:
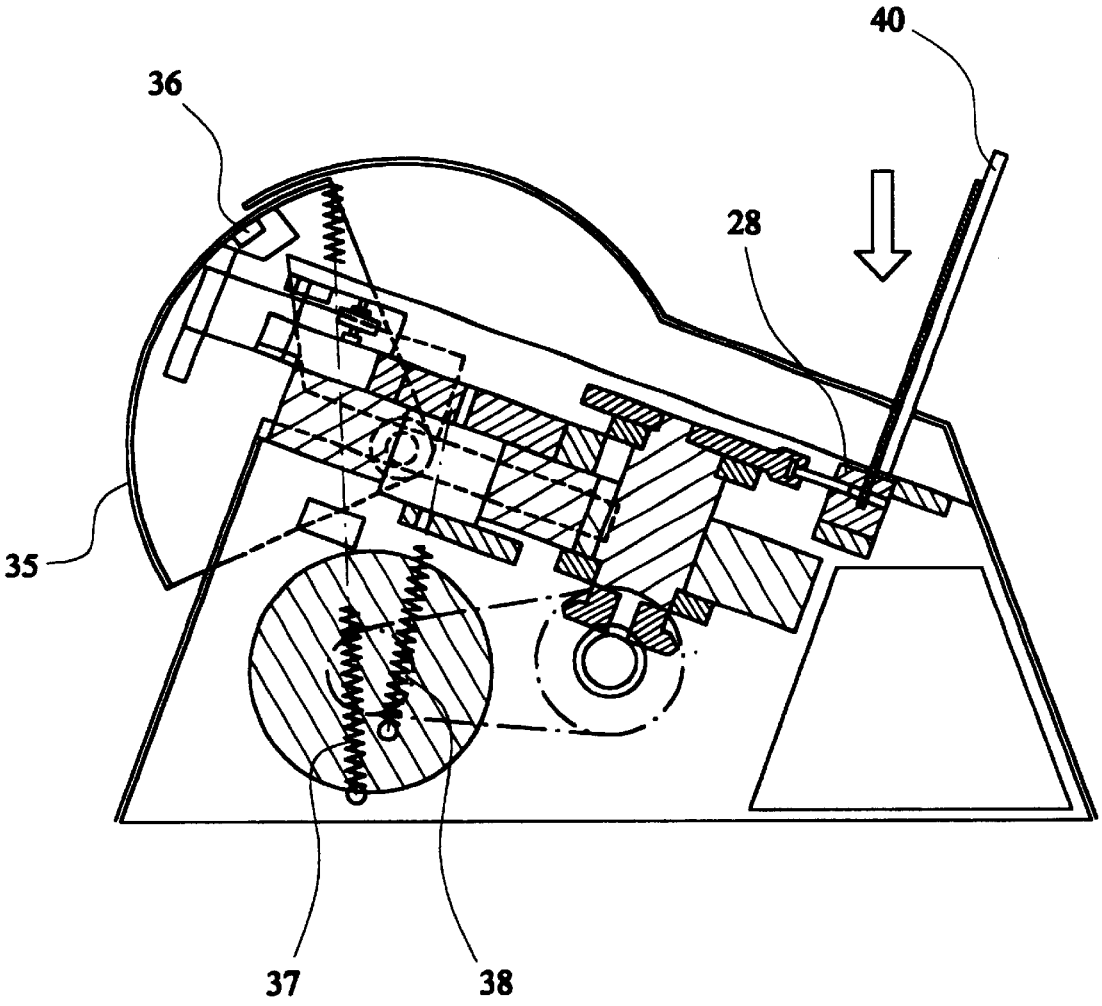
FIG. 14 illustrates the placement of the paper.

FIG. 14—Paper placement; stage no. 3

1. Paper is dropped in the die (item 28) using the paper support (40) as a guide.

Figure 15:
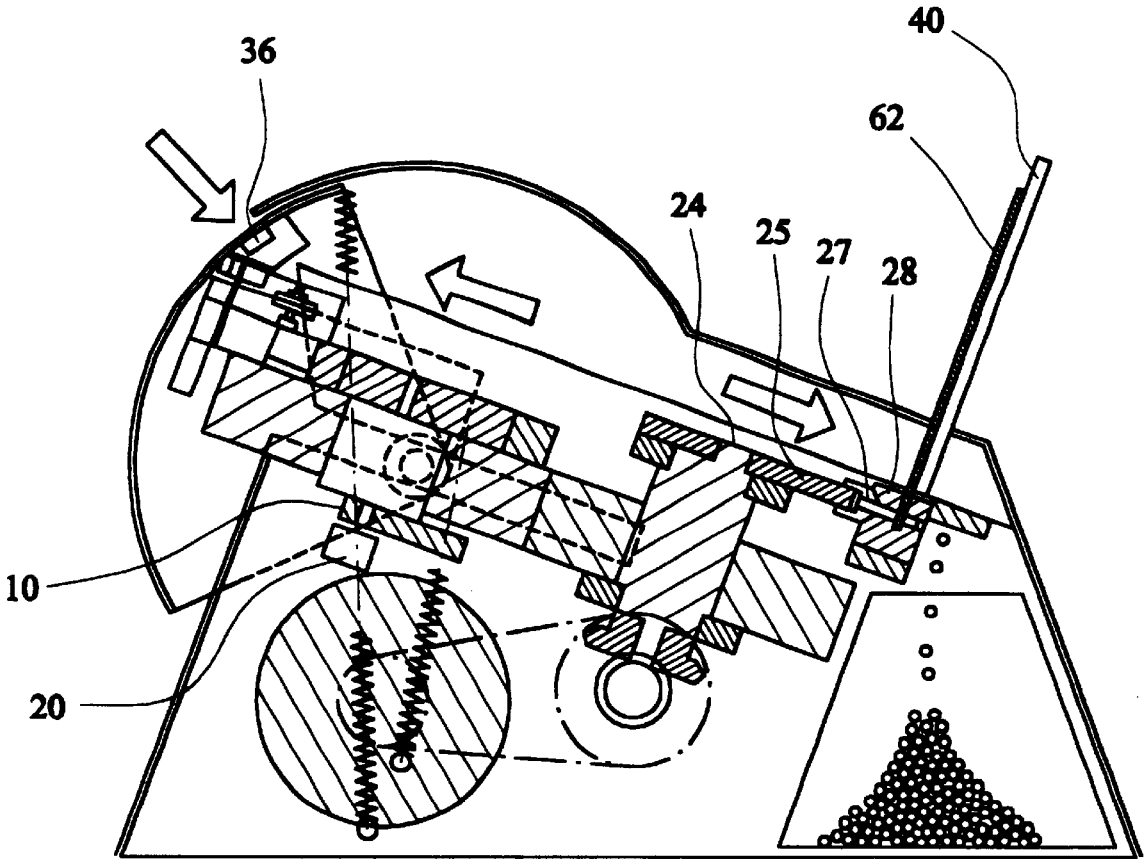
FIG. 15 illustrates the punching operation.

FIG. 15—punching; stage no. 4

1. When two button type switches are located at either end of the control console (36) are pressed simultaneously the main drive is activated which rotates the cam shaft (24).
2. The eccentric end of the cam shaft locates within a slot in the punch drive plate (25), when the cam shaft rotates the plate moves in a linear motion and pushes the punch pins (27) through the die (28) and the paper.
3. When the cam (10) hits limit switch (20) the drive is reversed until the original position is reached.

Figure 16:
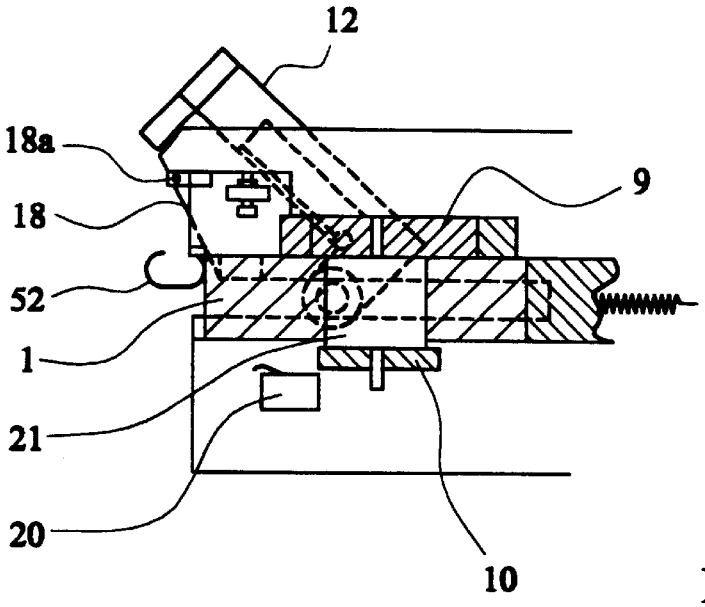
FIGS. 16 through 21 illustrate the adjustment mechanism.
Figure 17:
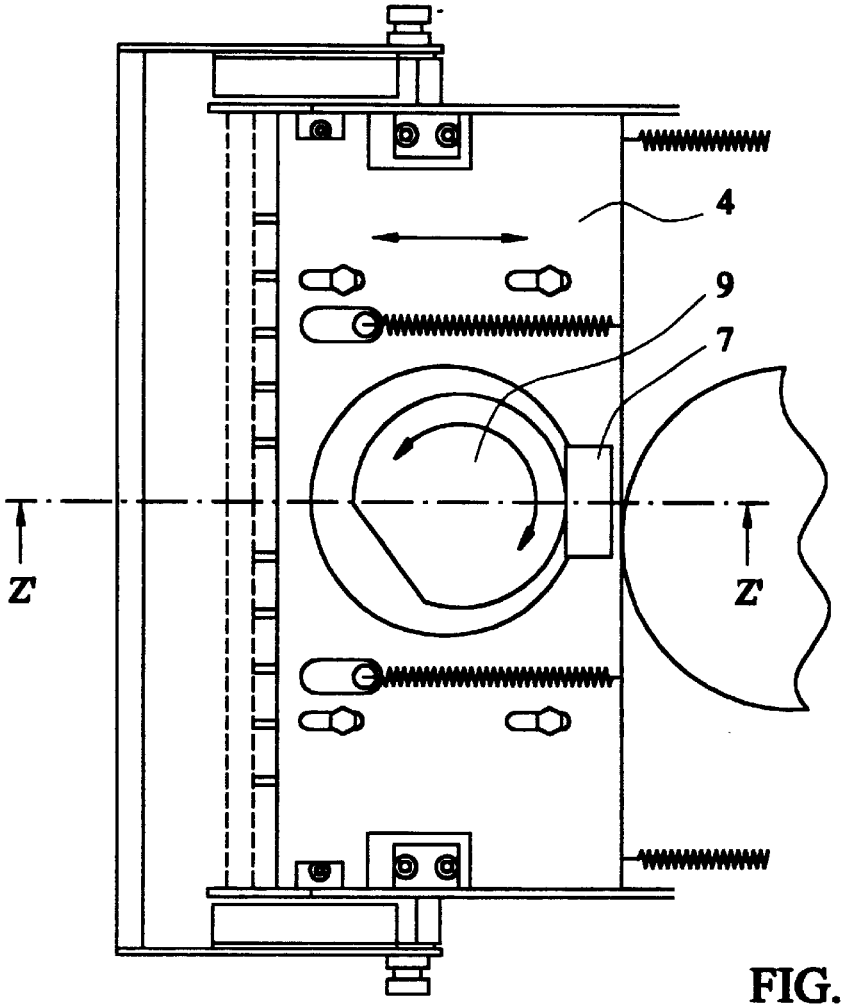

FIGS. 16 & 17—system adjustment

The system is designed to accept all wire sizes from small wires used on calendars to large wires used for binding documents over 25 mm thick. The correct setting will allow the wire to sit horizontal when loaded. This is achieved by positioning the wire retaining flap assy (18) relative to the base plate (1). The retaining flap assembly pivot is attached to the upper plate (4) and it is this upper plate that is moved relative to the base plate. When the wire size adjustment cam (9) is rotated it puts a force on the upper plate adjustment stop block (7) which is attached to the upper plate this moves the upper plate relative to the base plate. The cam is moved by the use of a stepper motor (21) that is located in the base plate. The stepper motos is actuated from the unit controller. The operator will enter the wire size on a keypad and this will in turn revolve the cam to its correct position. The stroke of the closer will vary depending in the size of the wire. The small wire will have the longest closing stroke and the largest wire the shortest. From the extended shaft from the bottom of the stepper motor there is the closing travel adjustment cam (10) this rotates together with the upper cam to give the required setting. When the base plate and all its attachments are moving and closing the wire the process is terminated when the cam hits a limit switch (20) which reverses the closing drive thus releasing the completed bound book and returning the base plate and all its attachments to its home position.

FIGS. 18 & 19—system adjustment; longest wire

FIGS. 20 & 21—system adjustment; smallest wire Stage no. 1

FIG. 22—wire hanging; stage no. 1

1. The wire is picked up by the operator and offered up to the hanging mechanism.
2. The wire is then pushed against the wire retaining flap assy (18), this in turn pivots backwards and as the pivot point is a distance in front of the flap face lifts the lower edge of the flap up.
3. The wire is slid down the flap face and the fingers in the finger plate (5) mate with the large loops in the wire.
4. When the wire larger loops almost touch the finger plate contact is lost between the wire and the flap assy this results in the flap pivoting back to its original position due to gravity.

5. The wire is released by the operator and is retained between the finger plate and flap assy.

FIG. 23—paper loading; stage no. 2

1. Bundles of pre-punched paper are pushed over the tips of the wire and released so that they hang down.

FIG. 24—closer positioning

1. The closer arm is spring loaded in the upper position.
2. The operator pulls the closer into the lower position until the inner angle hits the stop (13).

FIG. 25—closing start

1. The main closing cam is activated (11) which pushes the base plate (1) and all its attachments toward the face of the closer bracket (12).
2. The closer locking pin is now above the angle on the closer bracket thus restricting any angular movement and locks the closer bracket in position.

FIG. 26—wire release

1. The closing surfaces of the base plate (1) and the closer bracket (12) are sand blasted so they are rough.
2. When the wire is gripped by the moving base plate it is held rigid.
3. When pressure is applied and the wire is crimped the tips of the wire follow the path shown.
4. The wire tip that is being restrained by the flap (18) moves forward and deflects the flap and as the pivot point of the flap is now on the flap centre line and not in front as when it was pushed in the other direction, the lower edge of the flap will rise relative to the wire until the wire is released.
5. The fingers that are on the finger plate (5) will also deflect thus aiding the release of the wire.

FIG. 27—stroke complete

1. When the closing travel cam (10) hits the closing travel limit (20) the drive to the main drive cam (11) is reversed allowing the base plate to return to its original position by the means of the base plate return springs (22).
2. The completed is naturally automatically released.

FIG. 28—load

1. The spring loaded closer bracket is allowed to return to its original position ready for the next load.

What is claimed is:

1. A binding machine for binding together a number of punched sheets of paper, the machine including means for temporarily retaining a wire binding element having closed points and open roots so as to allow punched sheets to be hung thereon;

means for closing the retained wire binding element so that the closed points come into the vicinity of the open roots, wherein the means for retaining the wire binding element includes a flap having an edge and a finger plate comprising a number of projections or fingers, the flap being mounted for movement pivotally from an equilibrium position in which the edge of the flap is proximate the projections or fingers, whereby insertion of a binding element urges the flap pivotally away from the equilibrium position and whereby upon a subsequent return of the flap to the equilibrium position the wire binding element is retained in a generally horizontal orientation between the edge of the flap and the fingers.

2. A binding machine as claimed in claim 1, wherein the fingers are resiliently deformable.

3. A binding machine as claimed in claim 1, wherein the flap is resiliently deformable.

4. A binding machine as claimed in claim 1, wherein the position of the flap is adjustable with respect to the closing means.

5. A binding machine as claimed in claim 1, wherein the closing means comprises a base plate having an edge portion facing a closing surface, these two components being mounted for relative movement towards and away from each other whereby a wire binding element held therebetween is closed.

6. A binding machine as claimed in claim 5, wherein the closing surface comprises a pivoting arm moveable between an inoperative up position and an operative down position.

7. A binding machine as claimed in claim 6, wherein the base plate is arranged for to and fro movement relative to the pivoting arm.

8. A binding machine as claimed in claim 5, wherein the position of the flap relative to the base plate is adjusted by means of a cam and cam follower arrangement.

9. A binding machine as claimed in claim 1, wherein the pivot axis of the flap is positioned forwardly of the flap, whereby outward flexing of the flap will cause the flap lower edge to list slightly, opening a gap between the fingers and the flap into which the closed binding element is released.

10. A binding machine as claimed in claim 1, wherein the pivot axis of the flap is on the flap centre line when releasing and in front when loading.

11. A binding machine for binding together a number of punched sheets of paper, the machine including means for temporarily retaining a wire binding element having closed points and open roots so as to allow punched sheets to be hung thereon, said means comprising a pivoting flap cooperating with a finger plate comprising a plurality of resiliently deformable projections or fingers so as to temporarily retain the binding element therebetween;

means for closing the retained wire binding element so that the closed points come into the vicinity of the open roots, wherein upon completion of closure of the wire binding element the bound document is automatically released from the machine.

12. A binding machine as claimed in claim 11, wherein the flap is resiliently deformable.

13. A binding machine as claimed in claim 11, wherein the pivot axis of the flap is positioned forwardly of the flap, whereby outward flexing of the flap will cause the flap lower edge to lift slightly, opening a gap between the fingers and the flap into which the closed binding element is released.

14. A binding machine as claimed claim 11, wherein the pivot axis of the flap is on the flap centre line when releasing and in front when loading.

* * * * *